US010345074B1

(12) United States Patent
Zamlinskiy

(10) Patent No.: US 10,345,074 B1
(45) Date of Patent: Jul. 9, 2019

(54) FIREARM CHASSIS SYSTEM

(71) Applicant: Aleksey Zamlinskiy, Roswell, GA (US)

(72) Inventor: Aleksey Zamlinskiy, Roswell, GA (US)

( * ) Notice: Subject to any disclaimer, the term of this patent is extended or adjusted under 35 U.S.C. 154(b) by 0 days.

(21) Appl. No.: 15/904,132

(22) Filed: Feb. 23, 2018

(51) Int. Cl.

| | |
|---|---|
| ***F41C 23/14*** | (2006.01) |
| ***F41A 3/66*** | (2006.01) |
| ***F41A 19/09*** | (2006.01) |
| ***F41C 23/16*** | (2006.01) |
| ***F41C 23/10*** | (2006.01) |
| ***F41C 7/00*** | (2006.01) |

(52) U.S. Cl.
CPC ..... *F41C 23/14* (2013.01); *F41A 3/66* (2013.01); *F41A 19/09* (2013.01); *F41C 7/00* (2013.01); *F41C 23/10* (2013.01); *F41C 23/16* (2013.01)

(58) Field of Classification Search
CPC ..... F41C 23/14; F41C 23/16; F41C 23/20; F41A 11/00
USPC ..... 42/75.02, 75.03, 75.1
See application file for complete search history.

(56) References Cited

U.S. PATENT DOCUMENTS

| | | | | |
|---|---|---|---|---|
| 1,307,594 | A | 6/1919 | Newman | |
| 1,909,425 | A | 5/1933 | Reid | |
| 2,457,296 | A | 12/1948 | Yawman | |
| 2,586,317 | A | 2/1952 | Fay | |
| 2,589,227 | A | 3/1952 | Colley | |
| 2,920,413 | A | 1/1960 | Marhefka et al. | |
| 3,184,875 | A | 5/1965 | Klebe | |
| 3,206,884 | A | 9/1965 | Purvis | |
| 3,488,488 | A | 1/1970 | Crouch | |
| 3,611,607 | A | 10/1971 | Donnell | |
| 4,499,683 | A | 2/1985 | Savioli | |
| 4,601,123 | A | 7/1986 | Swearengen et al. | |
| 4,667,429 | A | 5/1987 | Perazzi | |
| 4,677,781 | A | 7/1987 | Lee | |
| 4,685,379 | A | 8/1987 | Troncoso | |
| 4,691,461 | A | 9/1987 | Behlert | |
| 4,803,910 | A | 2/1989 | Troncoso | |
| 4,869,008 | A | 9/1989 | Rasmussen | |
| 5,212,327 | A | 5/1993 | Schuemann | |
| 5,416,998 | A | 5/1995 | Martel | |
| 5,780,762 | A | 7/1998 | Kobayashi | |
| 5,797,206 | A | 8/1998 | Vitorino | |
| 6,250,194 | B1 * | 6/2001 | Brandl | F41A 19/18 42/71.01 |
| 6,367,465 | B1 | 4/2002 | Buccieri, Jr. | |

(Continued)

OTHER PUBLICATIONS

Dave Sutherland, SKS Bullpups [online], [retrieved on Aug. 21, 2007], Retrieved from the internet: <URL: http://www.simonov.net/bullpup.htm>.

(Continued)

*Primary Examiner* — Stephen Johnson
(74) *Attorney, Agent, or Firm* — Asgaard Patent Services, LLC; F. Wayne Thompson, Jr.

(57) ABSTRACT

Implementations of a firearm chassis system are provided. In some implementations, the firearm chassis system may be used to convert a firearm between: a bullpup configuration in which a pistol grip and trigger are positioned in front of the action of the firearm; and a rifle configuration in which the pistol grip and trigger are positioned below the action of the firearm. In some implementations, the present invention is directed to a firearm chassis system that is configured for use with the barreled action of an SKS type rifle.

20 Claims, 38 Drawing Sheets

(56) References Cited

U.S. PATENT DOCUMENTS

| | | | | |
|---|---|---|---|---|
| 6,526,683 | B1 | 3/2003 | Crandall | |
| 6,598,329 | B1 | 7/2003 | Alexander | |
| 6,807,763 | B1 | 10/2004 | Leung | |
| 6,839,998 | B1 * | 1/2005 | Armstrong | F41C 23/00 42/71.01 |
| 6,901,691 | B1 | 6/2005 | Little | |
| 7,146,762 | B1 | 12/2006 | Leung | |
| 7,231,861 | B1 | 6/2007 | Gauny et al. | |
| 7,356,958 | B2 | 4/2008 | Weir | |
| 7,487,768 | B2 | 2/2009 | Hatcher | |
| 8,327,749 | B2 | 12/2012 | Underwood | |
| 8,782,940 | B1 | 7/2014 | Morris | |
| 8,819,976 | B1 * | 9/2014 | Kellgren | F41A 21/482 42/6 |
| 9,015,981 | B2 | 4/2015 | Zamlinsky | |
| 9,109,856 | B1 | 8/2015 | Zamlinsky | |
| 9,151,575 | B2 | 10/2015 | Pereira | |
| 2006/0048425 | A1 | 3/2006 | Frickey | |
| 2006/0048426 | A1 | 3/2006 | Crandall et al. | |
| 2006/0048427 | A1 | 3/2006 | Crandall et al. | |
| 2006/0048429 | A1 | 3/2006 | Crandall et al. | |
| 2006/0048430 | A1 | 3/2006 | Crandall et al. | |
| 2013/0185975 | A1 | 7/2013 | Johnson | |
| 2015/0338181 | A1 * | 11/2015 | McAlister | F41A 19/10 42/6 |

OTHER PUBLICATIONS

Dave Sutherland, SKS Bullpups [online], [archived on Mar. 3, 2001], [retrieved on Aug. 21, 2007], Retrieved from the internet: <URL:http://web.archive.org/web/20010303045437/http://www.simonov.net/bullpup.htm>.

Rifle Tech [online], [retrieved on Aug. 21, 2007], Retrieved from the internet: <URL: http://www.rifletech.net/bullpup.htm>.

Rifle Tech [online], [archived on Dec. 19, 2002], [retrieved on Aug. 21, 2007], Retrieved from the internet: <URL: http://web.archive.org/web/20021219113231/http://rifletech.com/bullpup.htm>.

Center Balanced Systems [online], [retrieved on Jul. 26, 2016], Retrieved from the internet: <URL: http://www.cbrps.com/SKS.html>.

SG Works [online], [retrieved on Jul. 26, 2016], Retrieved from the internet: <URL: http://www.http://sgworks.com/store/>.

* cited by examiner

FIREARM CHASSIS SYSTEM

TECHNICAL FIELD

This disclosure relates to implementations of a firearm chassis system.

BACKGROUND

In general, a conventionally configured rifle is a firearm with its action positioned in front of and/or above the trigger group and a "bullpup" is a firearm with its action positioned behind the trigger group. Both are designed to be fired from the shoulder and include a rifled barrel.

A bullpup will have a shorter overall length when compared to a conventionally configured rifle having a barrel of the same length. The shorter overall length of a bullpup offers improved maneuverability in confined spaces while retaining the benefits of a longer barrel, namely enhanced external and terminal ballistics.

While the action of a bullpup is moved rearward relative to the buttstock, the position of the trigger actuated by a finger of the user stays relatively the same. This requires a new mechanism to place this forward trigger into operational communication with the fire control group positioned adjacent the action of the firearm.

In certain instances, an end user of a conventionally configured rifle may desire to alter the appearance and functionally of their rifle into that of a bullpup. This may be done to improve ergonomics, reduce weight, and reduce overall length without compromising ballistic performance. Such a modification would be particularly desirable if it required minimal expertise and mechanical skill.

Conventionally configured rifles generally have better trigger mechanisms because they are located adjacent the action and do not rely on a trigger linkage to connect a forward trigger to a sear mechanism located adjacent the action. Also, due to the position of the action, a left-handed user can typically use a rifle having an ejection port on the right side without fear of being struck in the face by spent casings. For these and other reasons, some end users prefer a conventionally configured rifle.

Accordingly, it can be seen that needs exist for the firearm chassis system disclosed herein. It is to the provision of a firearm chassis system configured to convert the barreled action of a rifle into a conventionally configured rifle or a bullpup, based on the needs of the user, that the present invention is primarily directed. Also provided is a mechanism to position a secondary (or auxiliary) trigger forward of the action in order to complete the bullpup conversion.

SUMMARY OF THE INVENTION

Implementations of a firearm chassis system are provided. In some implementations, the firearm chassis system may be used to convert a firearm between a bullpup configuration and a rifle configuration.

In some implementations, the present invention is directed to a firearm chassis system that is configured for use with the barreled action of an SKS type rifle. In some implementations, the barreled action of the rifle may comprise an action (receiver and bolt), a barrel, a handguard cap, and a gas tube.

In some implementations, the firearm chassis system may comprise a base member that can be secured to the barreled action of the rifle, a handguard and a receiver member that can be secured to the base member, a pistol grip having an integrated trigger guard, a buttstock adaptor that can be secured to the receiver member, and a collapsible buttstock adjustably connected to the buttstock adaptor.

In some implementations, when the firearm chassis system is being used in the bullpup configuration, the firearm chassis system may further comprise a secondary (or auxiliary) trigger that can be positioned in front of the rifle's action, a trigger linkage configured to operably connect the second trigger to the primary trigger and hammer of a fire control group module positioned in the receiver member, and a removable cover used to enclose the underside of the receiver member and protect the primary trigger from inadvertent contact.

In some implementations, the firearm chassis system may be secured to the barreled action of a rifle and configured to position the pistol grip in front of the magazine well of the receiver member, this configuration may be referred to as the "bullpup configured rifle", or simply "bullpup".

In some implementations, when the pistol grip has been secured to the underside of the handguard, the secondary trigger extends through a slot in the underside of the handguard, through a slot in the pistol grip, and into the opening defined by the trigger guard. In this way, when the firearm chassis system is in the bullpup configuration, the secondary trigger is positioned to be pressed rearwardly by the index finger of the hand grasping the pistol grip.

In some implementations, the firearm chassis system may be secured to the barreled action of a rifle and configured to position the pistol grip behind the magazine well of the receiver member, this configuration may be referred to as the "rifle configuration", or simply "rifle".

In some implementations, when the pistol grip has been secured to the underside of the receiver member, the trigger of the fire control group module extends through an opening in the receiver member, through the slot in the pistol grip, and into the opening defined by the trigger guard. In this way, when the firearm chassis system is in the rifle configuration, the primary trigger is positioned to be pressed rearwardly by the index finger of the hand grasping the pistol grip.

In some implementations, the receiver member may include a magazine well. In some implementations, the magazine well may include a magazine catch mechanism configured to releasably retain an ammunition magazine within the opening of the magazine well. In some implementations, the magazine well of the receiver member may be configured to position an ammunition magazine so that ammunition contained therein may be feed into the chamber of the barrel by the action.

In some implementations, the fire control group module may comprise a hammer, a disconnector, the primary trigger, a safety selector, and a trigger engagement member. In some implementations, the trigger engagement member may be configured to raise the back end of the primary trigger and thereby release the hammer.

In some implementations, the trigger engagement member may include a load arm configured to fit underneath a rear portion of the primary trigger of the fire control group module and a trigger linkage joint configured to interface with a bend in the trigger linkage. In this way, when the trigger linkage moves rearwardly as a result of the secondary trigger being pressed, the trigger engagement member pivots causing the load arm thereof to lift the rearward end of the primary trigger, thereby releasing the hammer.

In some implementations, the collapsible buttstock may comprise a cheek piece, a butt-pad, and two guide shafts configured to adjustably connect the buttstock to the buttstock adaptor. In some implementations, the collapsible buttstock may be moveable between at least a first position (e.g., a fully collapsed position) and a second position (e.g., a fully extended position). In some implementations, the buttstock may be placed into the first position when the firearm chassis system is in the bullpup configuration. In some implementations, the buttstock may be placed into the second position when the firearm chassis system is in the rifle configuration.

In some implementations, a front end of the trigger linkage may be connected to the body portion of the secondary trigger. In some implementations, the trigger linkage may further comprise a first arm and a second arm that extend between the bend and the front end thereof.

These and other aspects, features, and advantages of the invention will be understood with reference to the drawing figures and detailed description herein, and will be realized by means of the various elements and combinations particularly pointed out in the appended claims. It is to be understood that both the foregoing general description and the following brief description of the drawings and the detailed description of the invention are exemplary and explanatory of preferred implementations of the invention, and are not restrictive of the invention, as claimed.

DETAILED DESCRIPTION

FIGS. 1A-1C, 2A-2B, 3, and 4A-4D illustrate an example firearm chassis system 100 according to the present disclosure. In some implementations, the firearm chassis system 100 may be used to convert a firearm between a bullpup configuration 105 (see, e.g., FIGS. 1A-1C) and a rifle configuration 110 (see, e.g., FIG. 3).

It is to be understood that the term "action" as used throughout this specification includes the bolt and/or receiver of a firearm. In some implementations, the firearm may be a Samozaryadny Karabin sistemy Simonova rifle, commonly referred to as an SKS rifle. An SKS rifle is typically chambered to fire 7.62×39 mm ammunition.

Figure 1A:
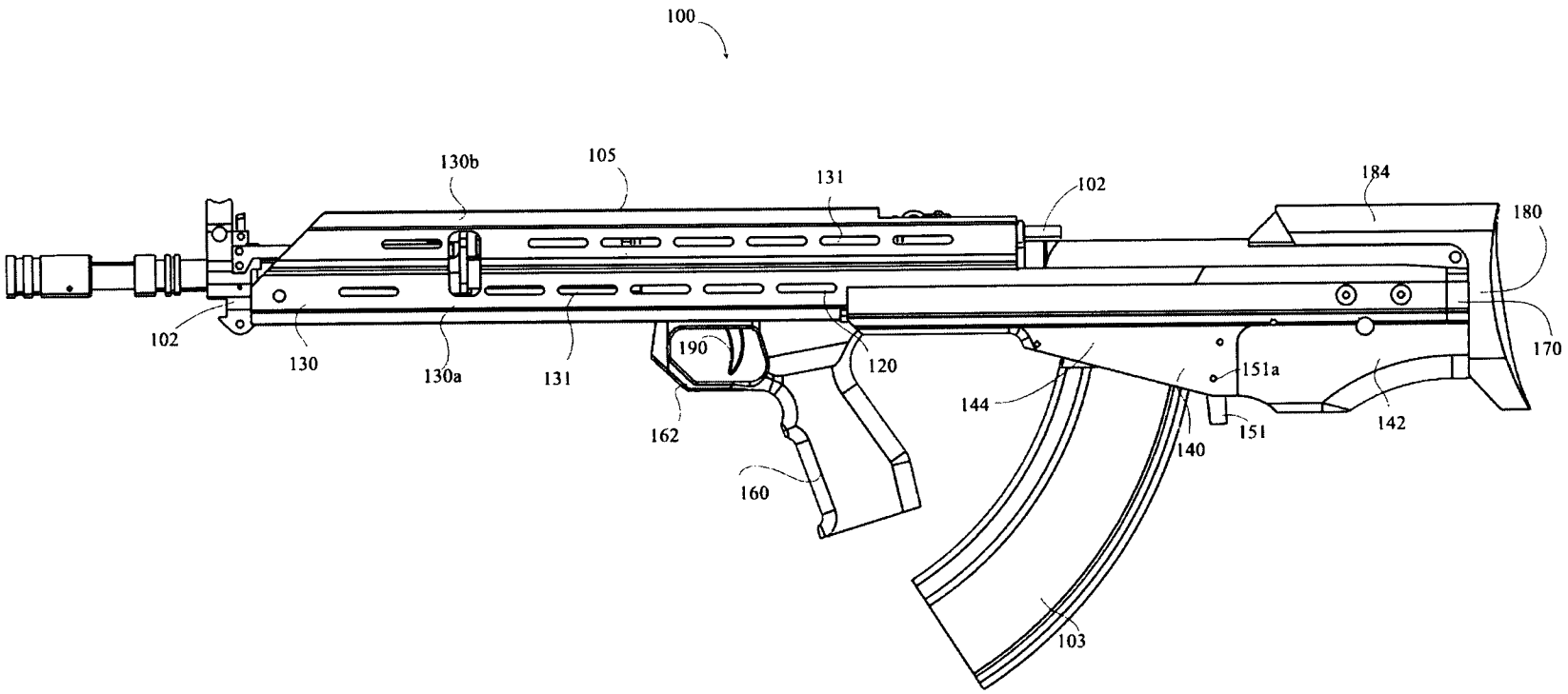
FIGS. 1A-1C illustrate an example firearm chassis system according to the principles of the present disclosure, wherein the firearm chassis system is in the bullpup configuration.
Figure 2A:
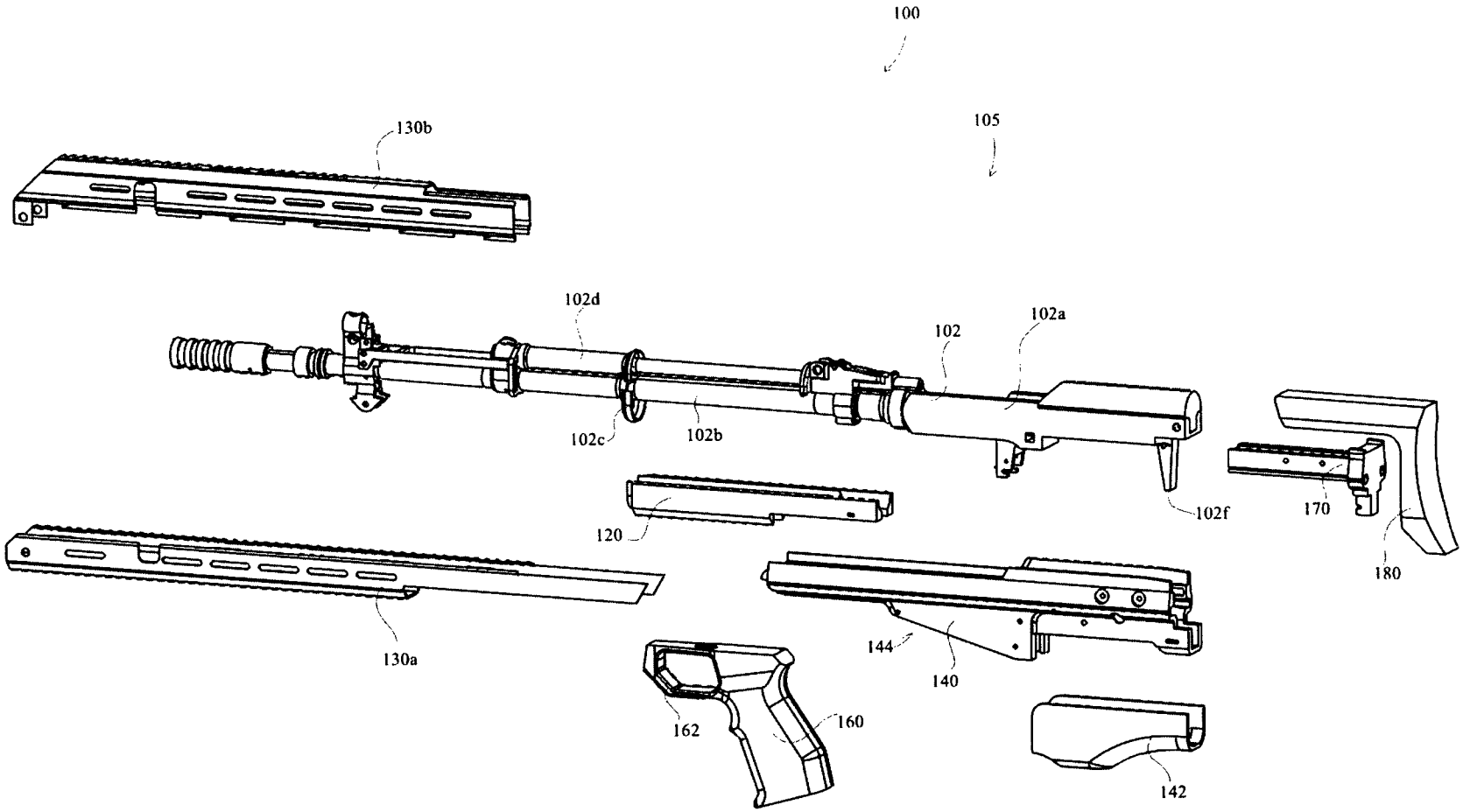
FIGS. 2A-2B illustrate exploded views of the firearm chassis system shown in FIGS. 1A-1C.
Figure 3:
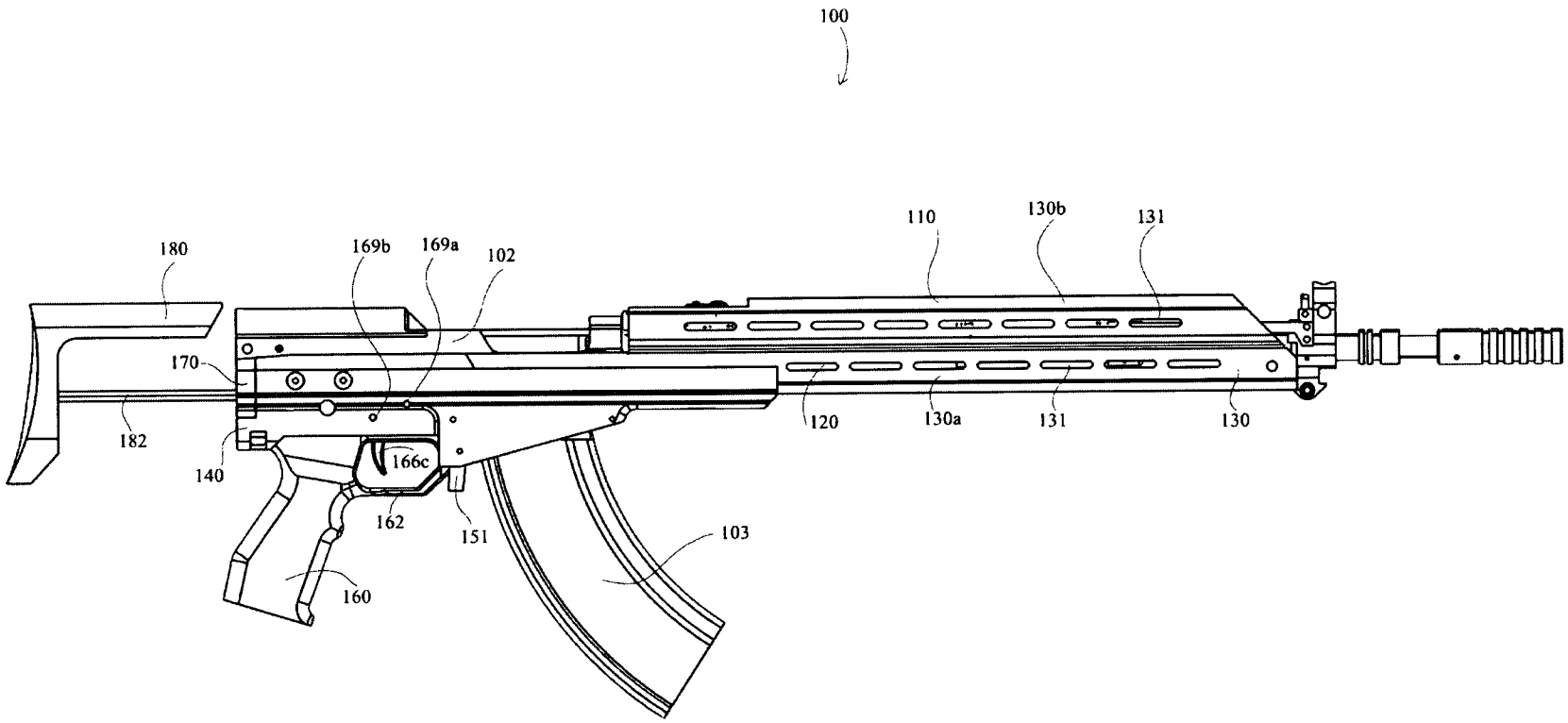
FIG. 3 illustrates another configuration of the firearm chassis system shown in FIGS. 1A-1C, wherein the firearm chassis system is in the rifle configuration.

As shown in FIGS. 1A and 3, in some implementations, the present invention is directed to a firearm chassis system 100 that is configured for use with the barreled action 102 of an SKS type rifle. In some implementations, the barreled action 102 of the rifle may comprise an action 102*a* (receiver and bolt), a barrel 102*b*, a handguard cap 102*c*, and a gas tube 102*d* (see, e.g., FIGS. 2A and 4A).

Figure 2B:
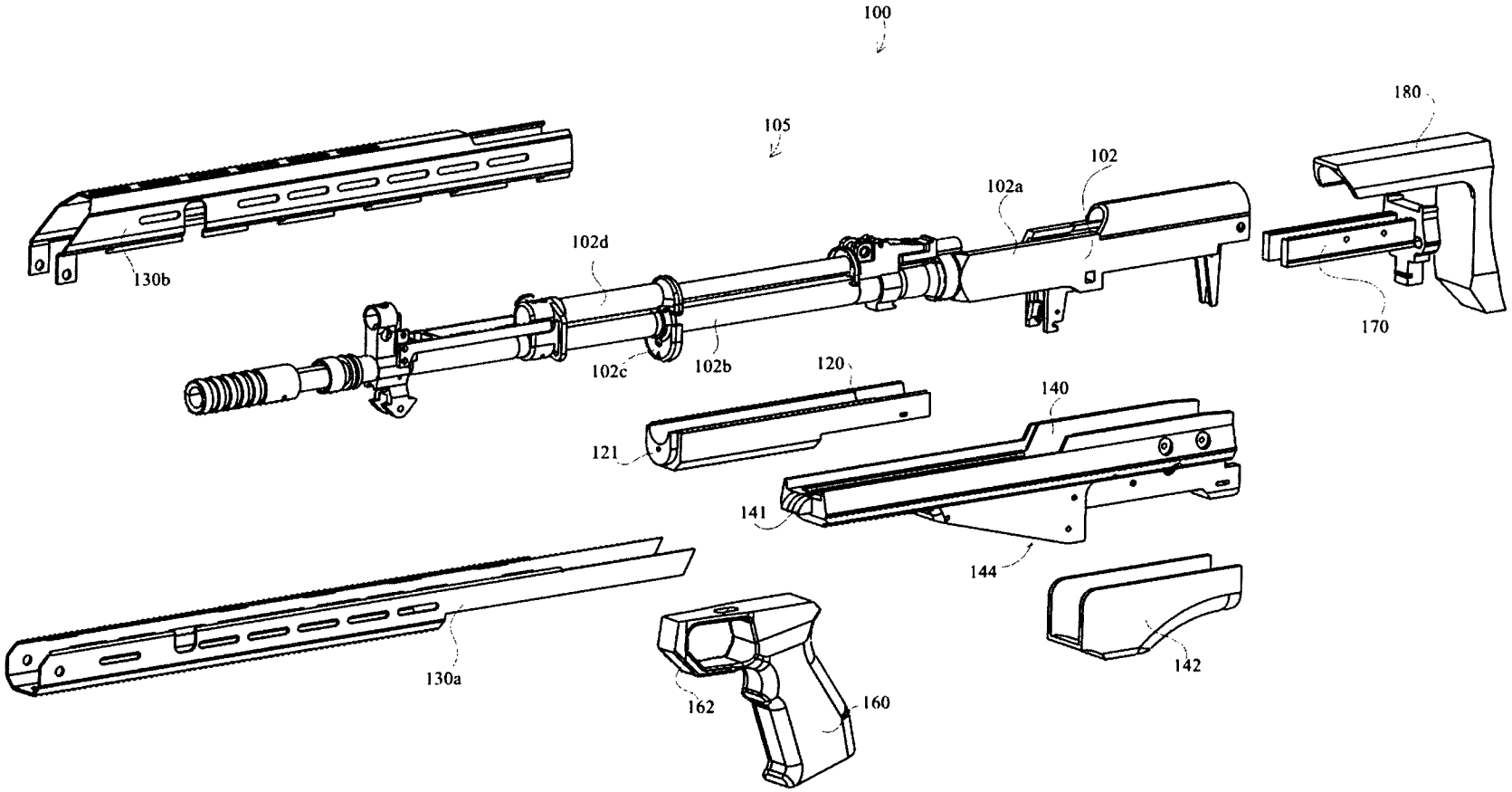
Figure 4A:
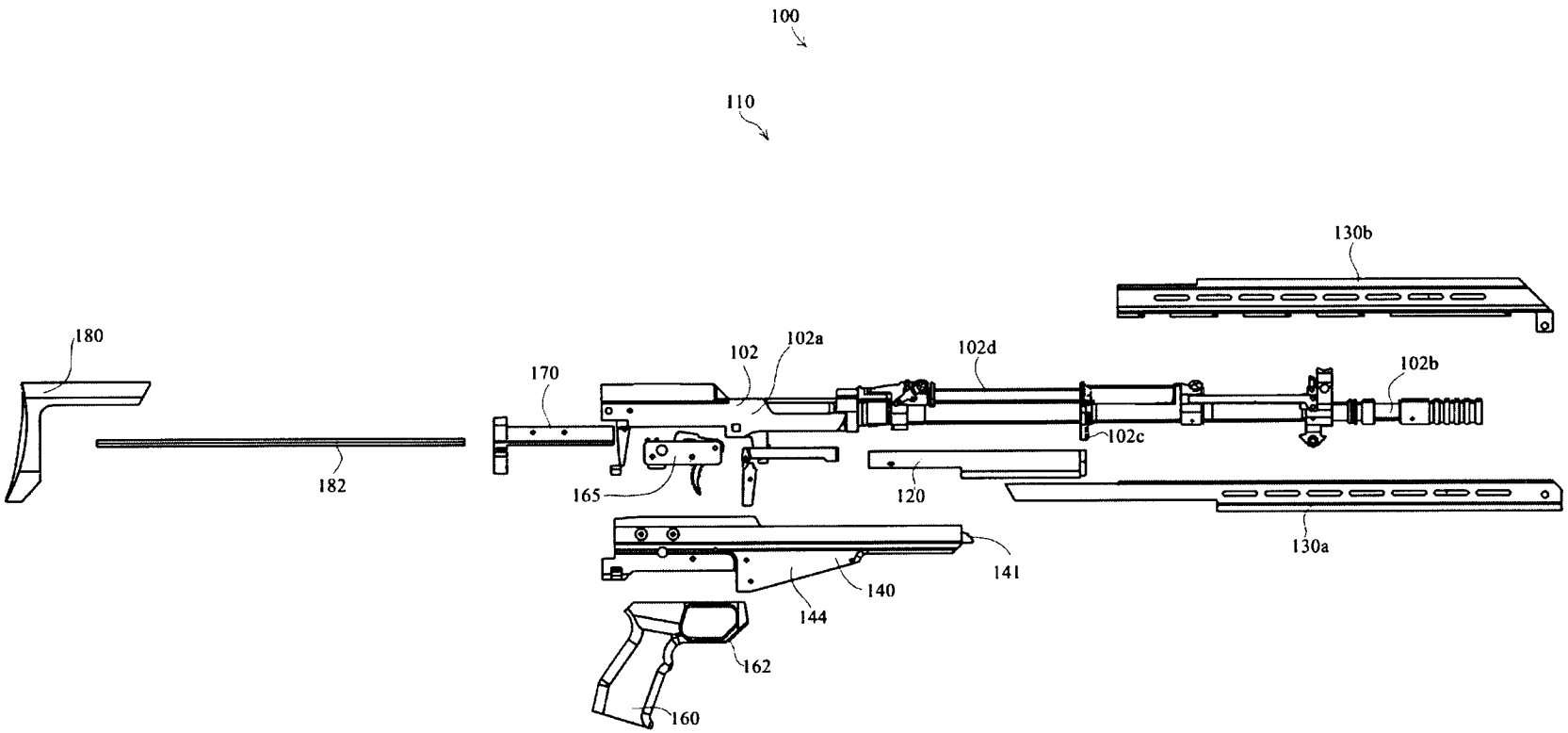
FIGS. 4A-4D illustrate exploded views of the firearm chassis system shown in FIG. 3.
Figure 4B:
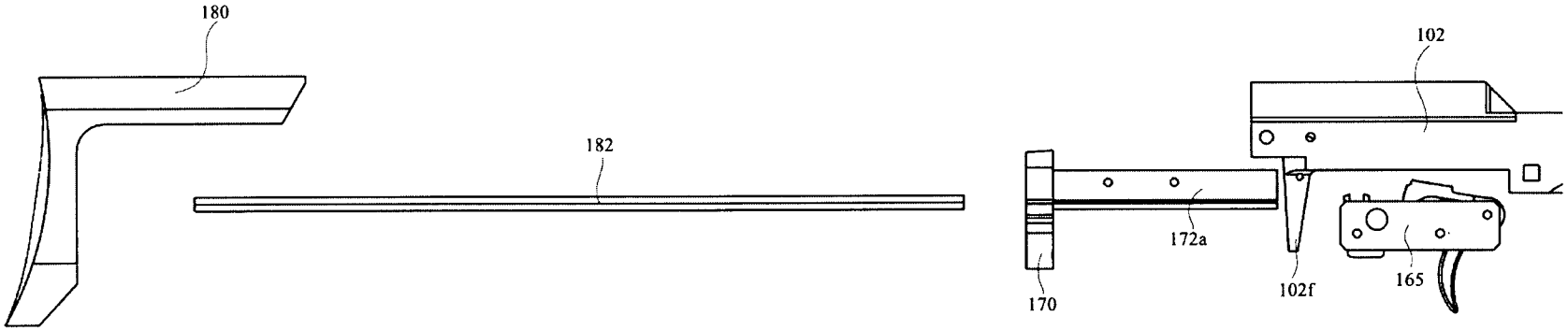
Figure 4C:
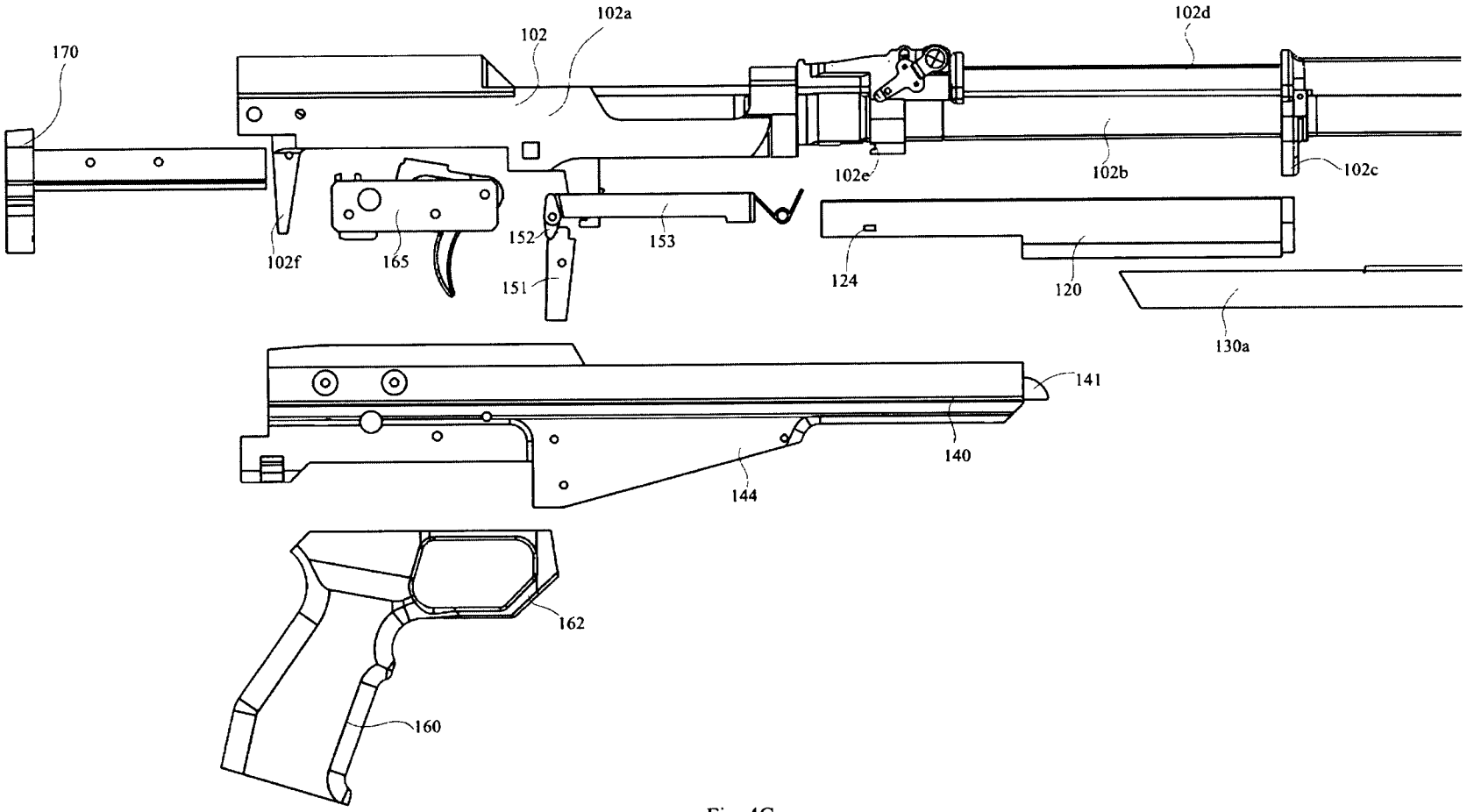
Figure 4D:
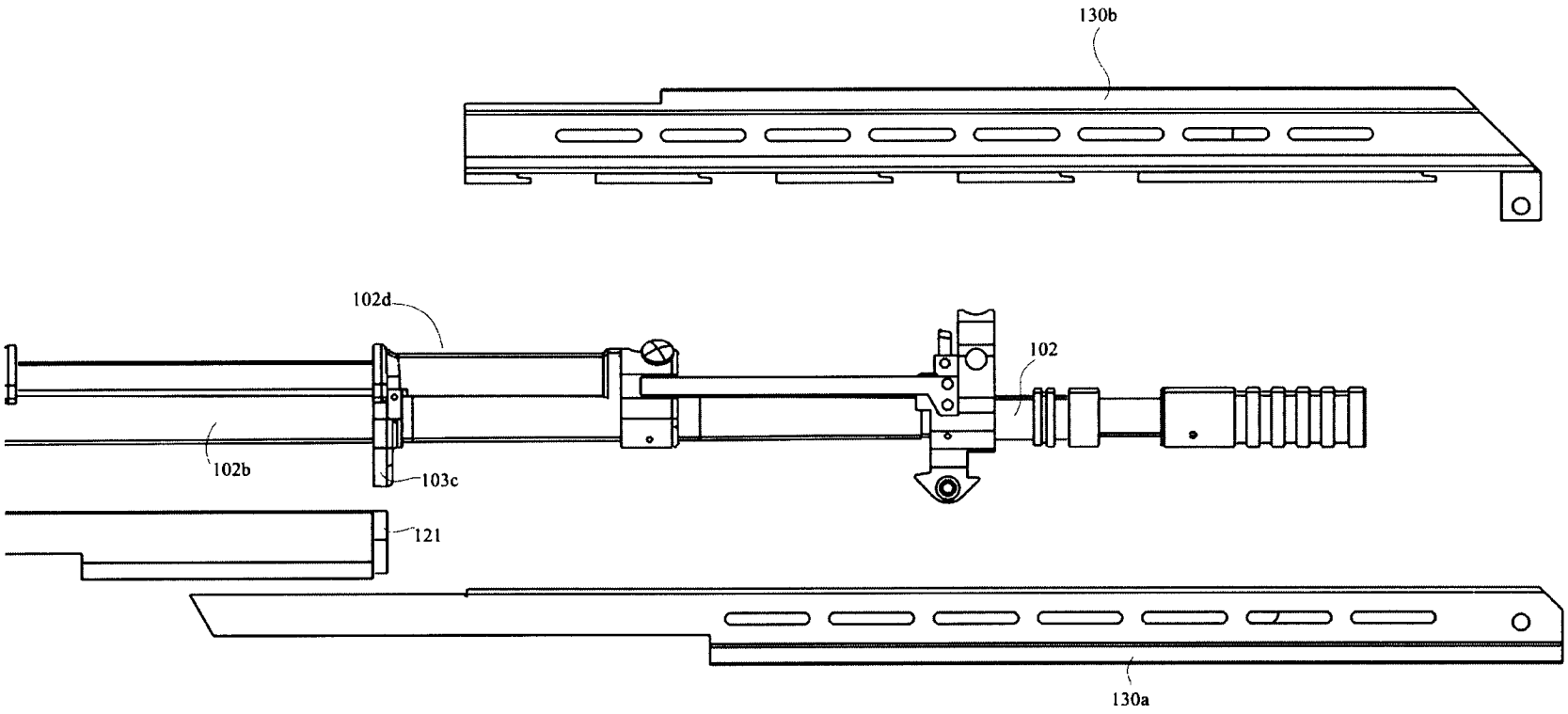

As shown in FIGS. 2A, 2B and 4A, in some implementations, the firearm chassis system 100 may comprise a base member 120, a handguard (130*a*, 130*b*), a receiver member 140, a pistol grip 160 having an integrated trigger guard 162, a buttstock adaptor 170, and a buttstock 180.

In some implementations, when the firearm chassis system 100 is being used in the bullpup configuration, the firearm chassis system 100 may further comprise a secondary trigger 190 (also referred to as an "auxiliary trigger") slidably positioned within the longitudinal slot 128 in the underside of the base member 120, a trigger linkage 192 configured to operably connect the secondary trigger 190 to the primary trigger 166*c* and hammer 166*a* of the fire control group module 165 positioned in the receiver member 140, and a removable cover 142 configured to enclose the underside of the receiver member and protect the primary trigger 166*c* of the fire control group module 165 from inadvertent contact.

Figure 1B:
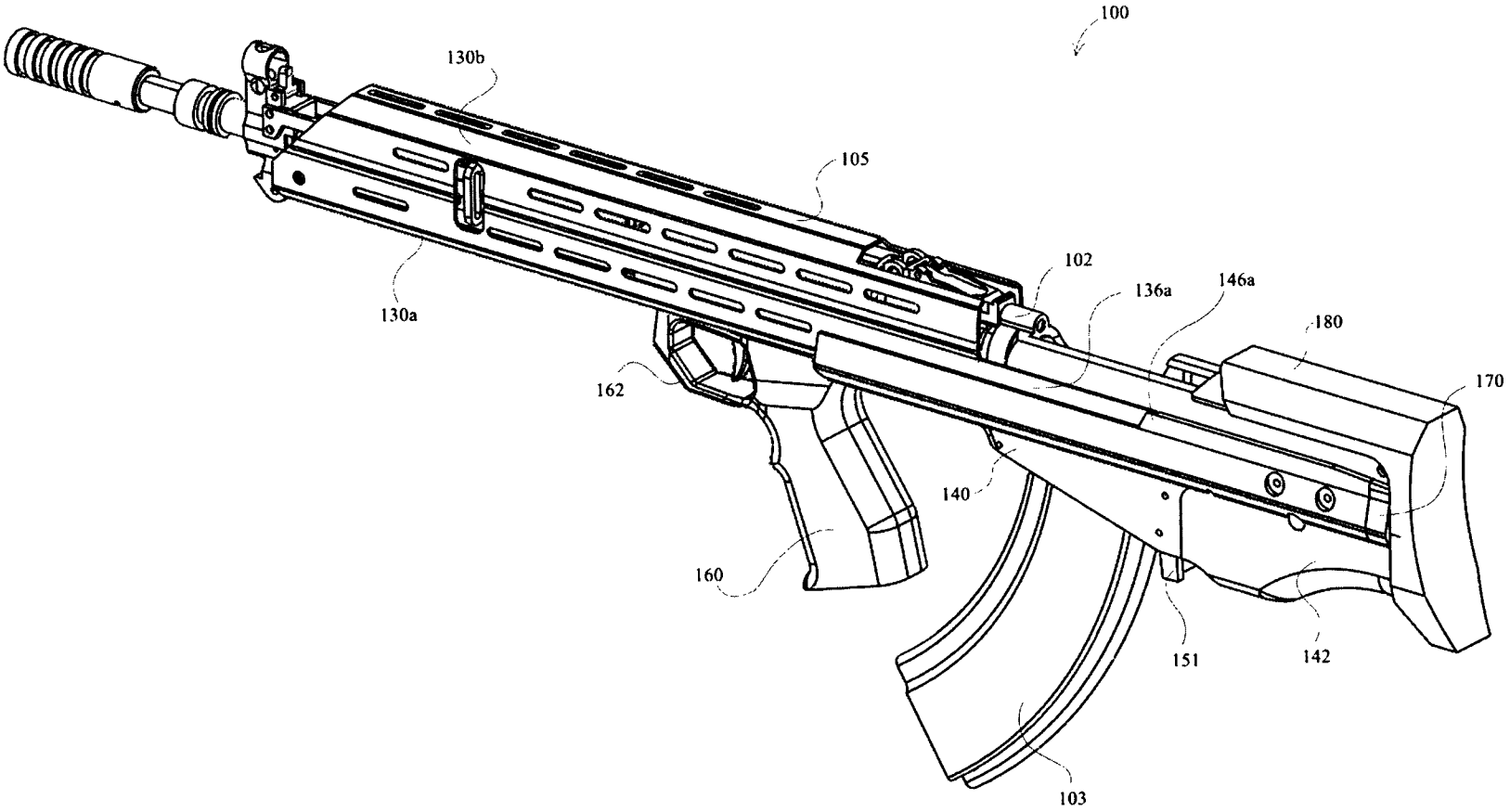
Figure 1C:
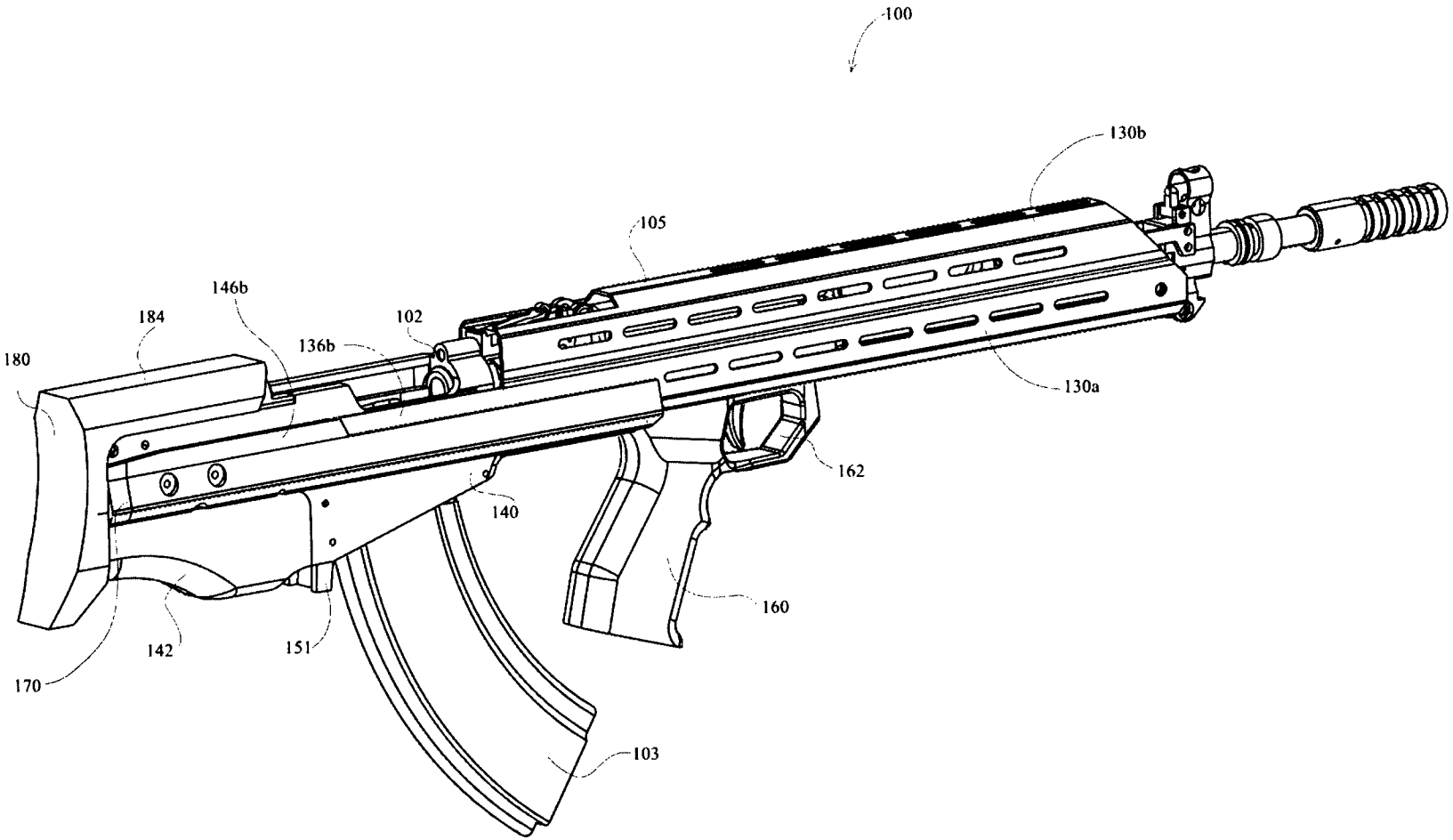

As shown in FIGS. 1A-1C, the firearm chassis system 100 may be secured to the barreled action 102 of a firearm and configured to position the pistol grip 160 in front of the magazine well 144 of the receiver member 140, this configuration may be referred to as the "bullpup configured rifle", or simply "bullpup", and is designated by reference number 105.

As shown in FIG. 1A, in some implementations, when the pistol grip 160 has been secured to the underside of the lower handguard section 130*a*, the secondary trigger 190 connected to the trigger linkage 192 may extend through a slot 134*a* in the lower handguard section 130*a*, through a slot 163 in the pistol grip 160, and into the opening defined by the trigger guard 162. In this way, when the firearm chassis system 100 is in the bullpup configuration 105, the secondary trigger 190 is positioned to be pressed rearwardly by the index finger of the hand grasping the pistol grip 160.

As shown in FIG. 3, the firearm chassis system 100 may be secured to the barreled action 102 of a firearm and configured to position the pistol grip 160 behind the magazine well 144 of the receiver member 140, this configuration may be referred to as the "rifle configuration", or simply "rifle", and is designated by reference number 110.

A shown in FIG. 3, in some implementations, when the pistol grip 160 has been secured to the underside of the receiver member 140, the primary trigger 166*c* of the fire control group module 165 may extend through an opening 140*a* in the receiver member 140, through the slot 163 in the pistol grip 160, and into the opening defined by the trigger guard 162. In this way, when the firearm chassis system 100 is in the rifle configuration 110, the primary trigger 166*c* is positioned to be pressed rearwardly by the index finger of the hand grasping the pistol grip 160.

As shown in FIG. 1A, in some implementations, the base member 120 of the firearm chassis system 100 may be secured to the barreled action 102 of a firearm. In some implementations, the base member 120 may be configured so that the lower handguard section 130*a* and/or the receiver member 140 may be removably secured thereto.

Figure 5A:
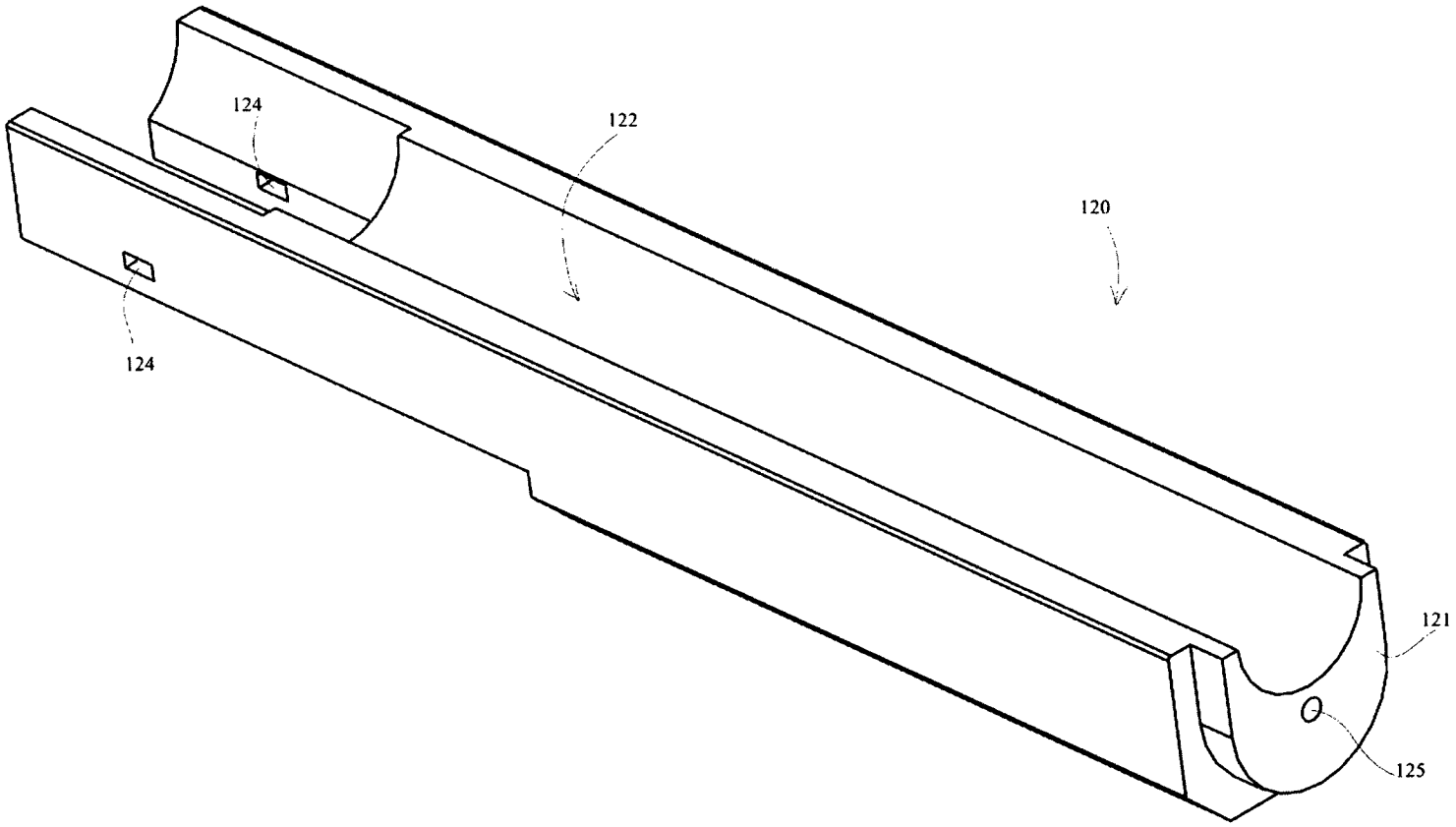
FIGS. 5A-5C illustrate an example base member according to the principles of the present disclosure.
Figure 5B:
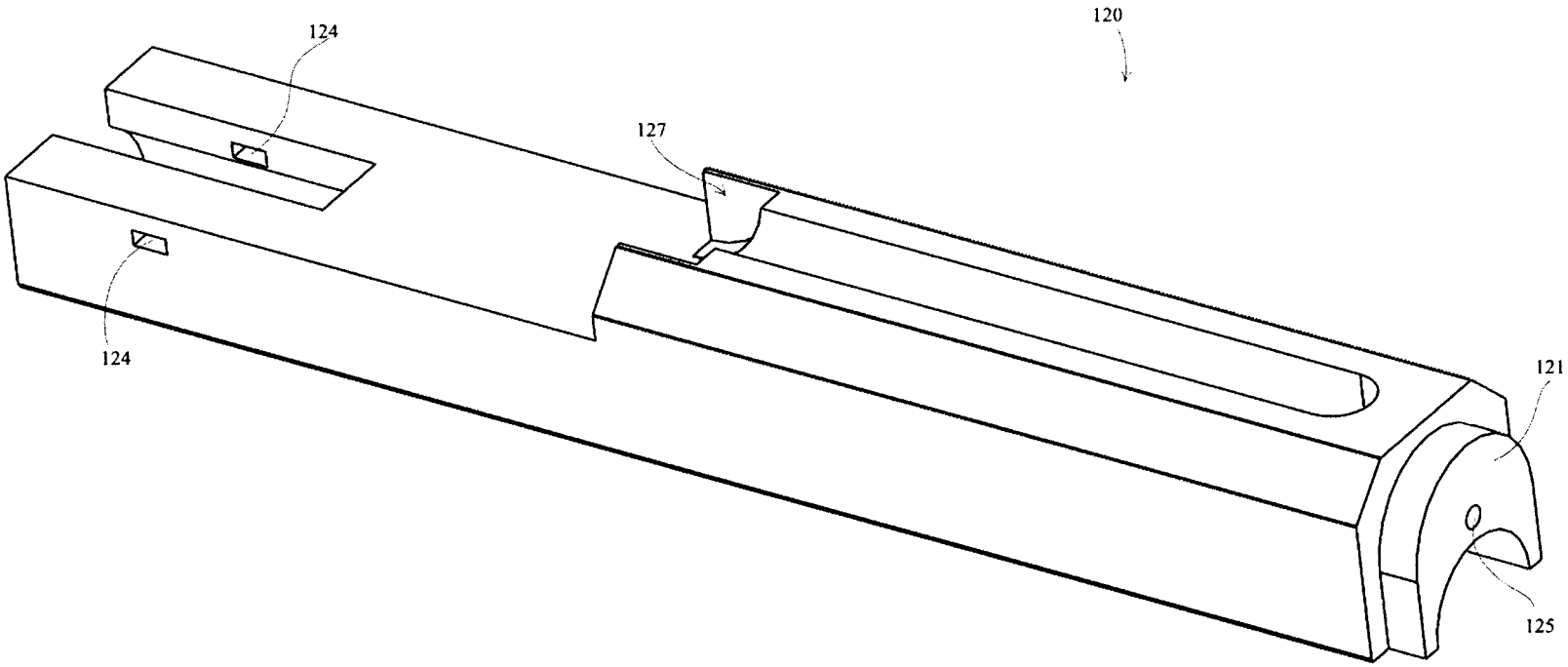

As shown in FIGS. 5A and 5B, in some implementations, the base member 120 may include a protrusion 121 on its front end configured to be received within a portion of the handguard cap 102*c* secured about the barrel 102*b* of the barreled action 102. In some implementations, the protrusion 121 of the base member 120 may have a "U" shaped contour. In some implementations, the protrusion 121 of the base member 120 may be any shape suitable for being received within the handguard cap 102*c* of the barreled action 102. In some implementations, the face of the protrusion 121 may include a threaded opening 125 therein. In some implementations, when the protrusion 121 of the base member 120 is positioned within the handguard cap 102*c*, the threaded opening 125 thereof may align with an opening, for a cleaning rod, that extends through the handguard cap 102*c*. In this way, a screw, or other suitable fastener, may be used to secure the front end of the base member 120 to the handguard cap 102*c* of the barreled action 102.

As shown in FIGS. 5A and 5B, in some implementations, the base member 120 may include a longitudinally extending channel 122 configured to receive a portion of the barrel 102*b* therein.

As shown in FIGS. 5A and 5B, in some implementations, the base member 120 may include a first arm 123*a* and a second arm 123*b* that extend from the back end thereof. In some implementations, the arms 123*a*, 123*b* of the base member 120 may be configured so that a portion of the barreled action 102 can fit therebetween. In some implementations, a transverse slot 124 may extend through the first arm 123*a* and the second arm 123*b* of the base member 120. In some implementations, the transverse slot 124 may be configured to receive a fastener, having a rectangular cross section, therein. In some implementations, when the base member 120 is secured to the barreled action 102, the transverse slot 124 extending through the arms 123 of the base member 120 may be aligned with the opening of the magazine hook 102*e* of the barreled action 102 (see, e.g., FIG. 4C). In this way, the fastener may be used to secure the back end of the base member 120 to the barreled action 102.

Figure 5C:
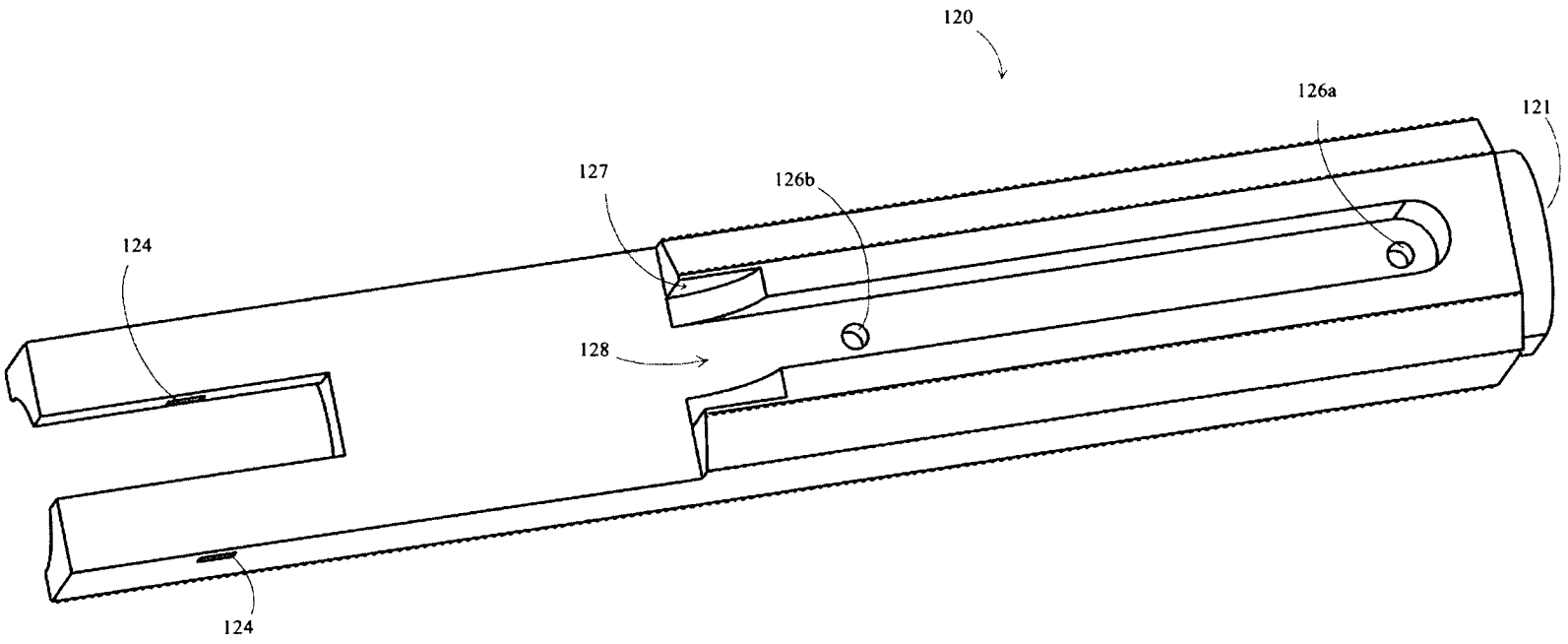

As shown in FIG. 5C, in some implementations, a longitudinal slot 128 in the underside of the base member 120 may include a first threaded opening 126*a* and a second threaded opening 126*b* therein. In some implementations, there may be more than two threaded openings 126 in the underside of the base member 120. In some implementation, the longitudinal slot 128 may be configured so that the secondary trigger 190 can slide back-and-forth therein.

As shown in FIG. 5C, in some implementations, the base member 120 may include a contoured surface 127 thereon that is configured to interface with the contoured bisected tip 141 extending from the front of the receiver member 140. In this way, the contoured surface 127 of the base member 120 may be configured to prevent the side-to-side movement of the receiver member 140. In some implementations, the contoured surface 127 may be any suitably shaped surface that is configured to interface with the bisected tip 141 of the receiver member 140.

In some implementations, the base member 120 may be secured to the barreled action 102 of a firearm using the following steps:

Initially, the protrusion 121 of the base member 120 may be inserted into the portion of the handguard cap 102*c* positioned about the barrel 102*b*.

Then, in some implementations, the transverse slot 124 may be positioned to align with the opening of the magazine hook 102*e* of the barreled action 102.

Next, in some implementations, a fastener may be inserted through a first opening (or end) of the transverse slot 124, through the opening of the magazine hook 102*e*, and into a second opening (or end) of the transverse slot 124.

Then, in some implementations, a screw, or other suitable fastener, may be inserted through the opening in the handguard cap 102*c* and threadedly secured within the threaded opening 125 in the face of the protrusion 121.

In some implementations, the base member 120 may be removed from the barreled action 102 of a firearm by performing the above steps in reverse order.

As shown in FIGS. 2A and 4A, in some implementations, the handguard 130 may comprise a lower handguard section 130*a* and an upper handguard section 130*b*. In some implementations, the lower handguard section 130*a* may be removably secured to the base member 120 of the firearm chassis system 100. In some implementations, the upper handguard section 130*b* may be removably secured to the lower handguard section 130*a*. In some implementations, the exterior surface(s) of the handguard 130 may be configured to provide surfaces that a user can ergonomically grip during operation of the firearm (e.g., 105, 110). In some implementations, the handguard 130 may include a longitudinally extending opening through which the barrel 102*b* extends.

Figure 6A:
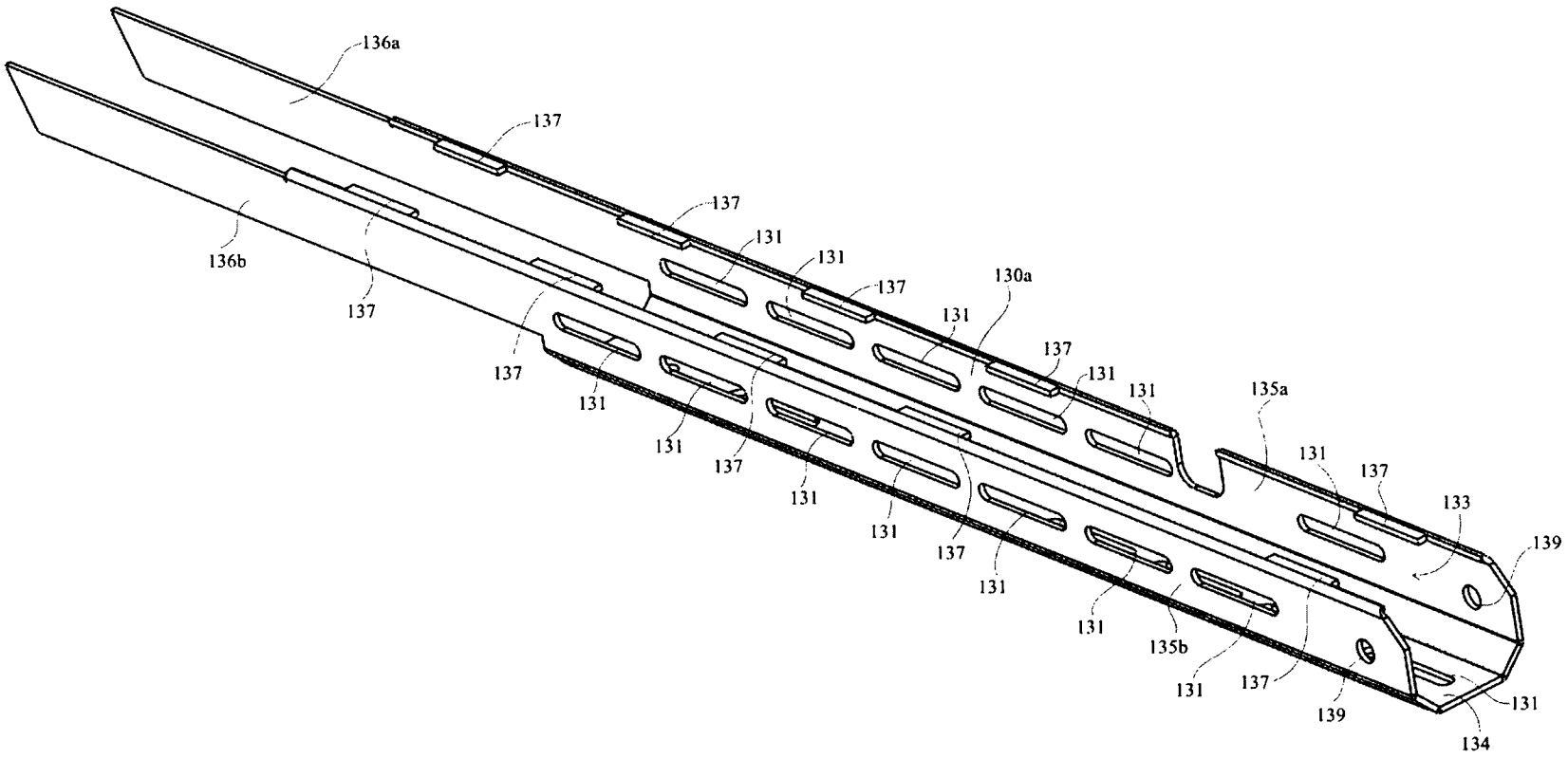
FIGS. 6A-6D illustrate an example lower handguard section and/or upper handguard section according to the principles of the present disclosure.
Figure 6B:
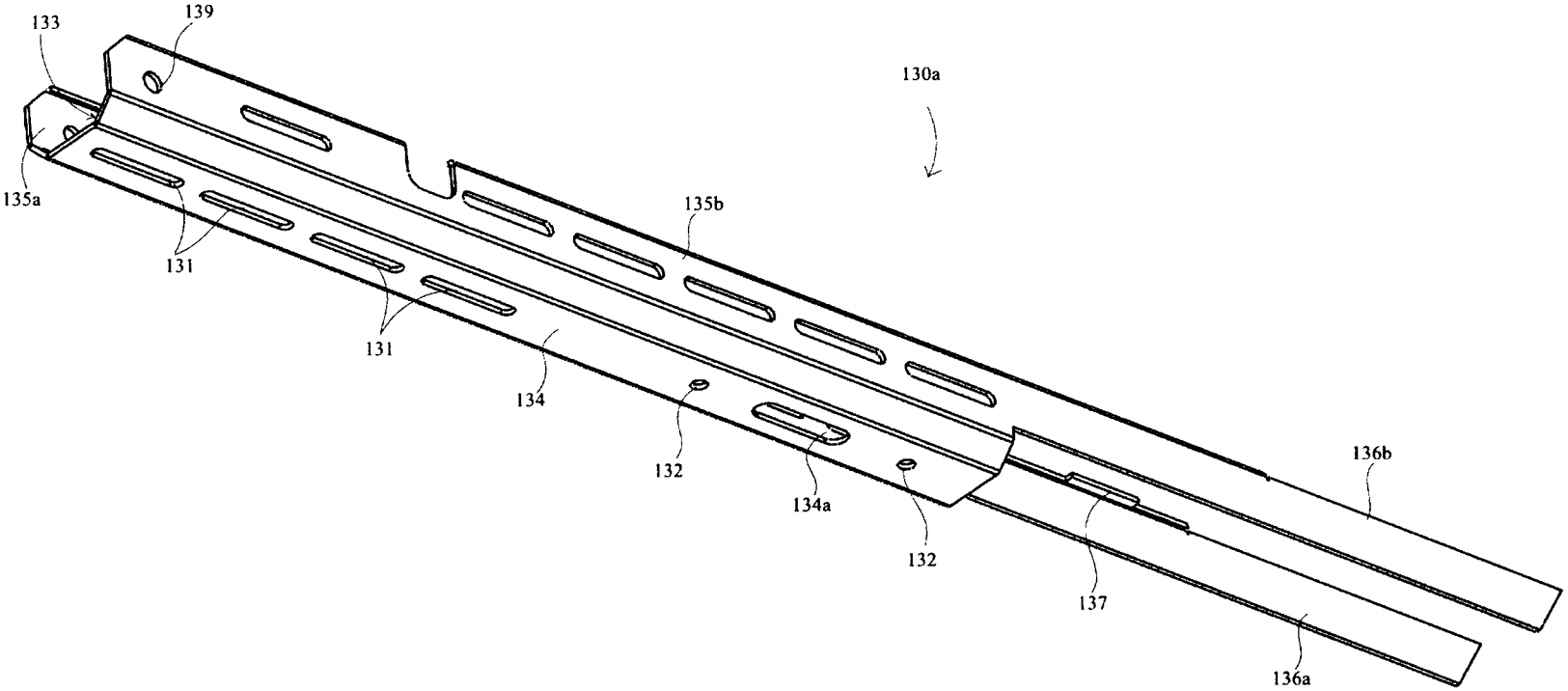

As shown in FIGS. 6A and 6B, in some implementations, the lower handguard section 130*a* may include a channel 133 therein configured to fit about a portion of the base member 120 of the firearm chassis system 100 and the barrel 102*b* of the barreled action 102. In some implementations, the lower handguard section 130*a* may comprise a bottom portion 134 having two sidewalls 135*a*, 135*b* extending upwardly therefrom. In some implementations, the channel 133 may be defined by the interior side of the bottom portion 134 and the two sidewalls 135*a*, 135*b* of the lower handguard section 130*a*. In some implementations, the lower handguard section 130*a* may further comprise a first arm 136*a* and a second arm 136*b* that extend from the back end of the first sidewall 135*a* and the second sidewall 135*b*, respectively (see, e.g., FIG. 6A). In some implementations, the first arm 136*a* and the second arm 136*b* of the lower handguard section 130*a* may be parallel to one another.

As shown in FIG. 6A, in some implementations, the sidewalls 135 and the arms 136 of the lower handguard section 130*a* may include a plurality of inwardly extending lips 137 thereon. In some implementations, at least a portion of each lip 137 may be positioned and configured to be received within a recess 138 of a slot 118 located in the bottom edge of the upper handguard section 130*b* (see, e.g., FIG. 6D).

As shown in FIG. 6A, in some implementations, the lower handguard section 130*a* may include a thru-bore 139 that extends through the first sidewall 135*a* and the second sidewall 135*b* thereof. In some implementations, the thru-bore 139 may be positioned adjacent the front end of the lower handguard section 130*a*.

As shown in FIG. 6B, in some implementations, there may be two openings 132 that extend through the bottom portion 134 of the lower handguard section 130*a*. In some implementations, when the lower handguard section 130*a* is positioned on the base member 120, the two openings 132 extending through the lower handguard section 130*a* align with the two threaded openings 126 in the underside of the base member 120. In this way, two screws, or other suitable fasteners, may be used to secure the lower handguard section 130*a* to the base member 120 of the firearm chassis system 100.

As shown in FIG. 6B, in some implementations, the bottom portion 134 of the lower handguard section 130*a* may include a slot 134*a* therein. In some implementations, the slot 134*a* may be positioned between the two openings 132 extending through the bottom portion 134 of the lower handguard section 130*a*.

Figure 6C:
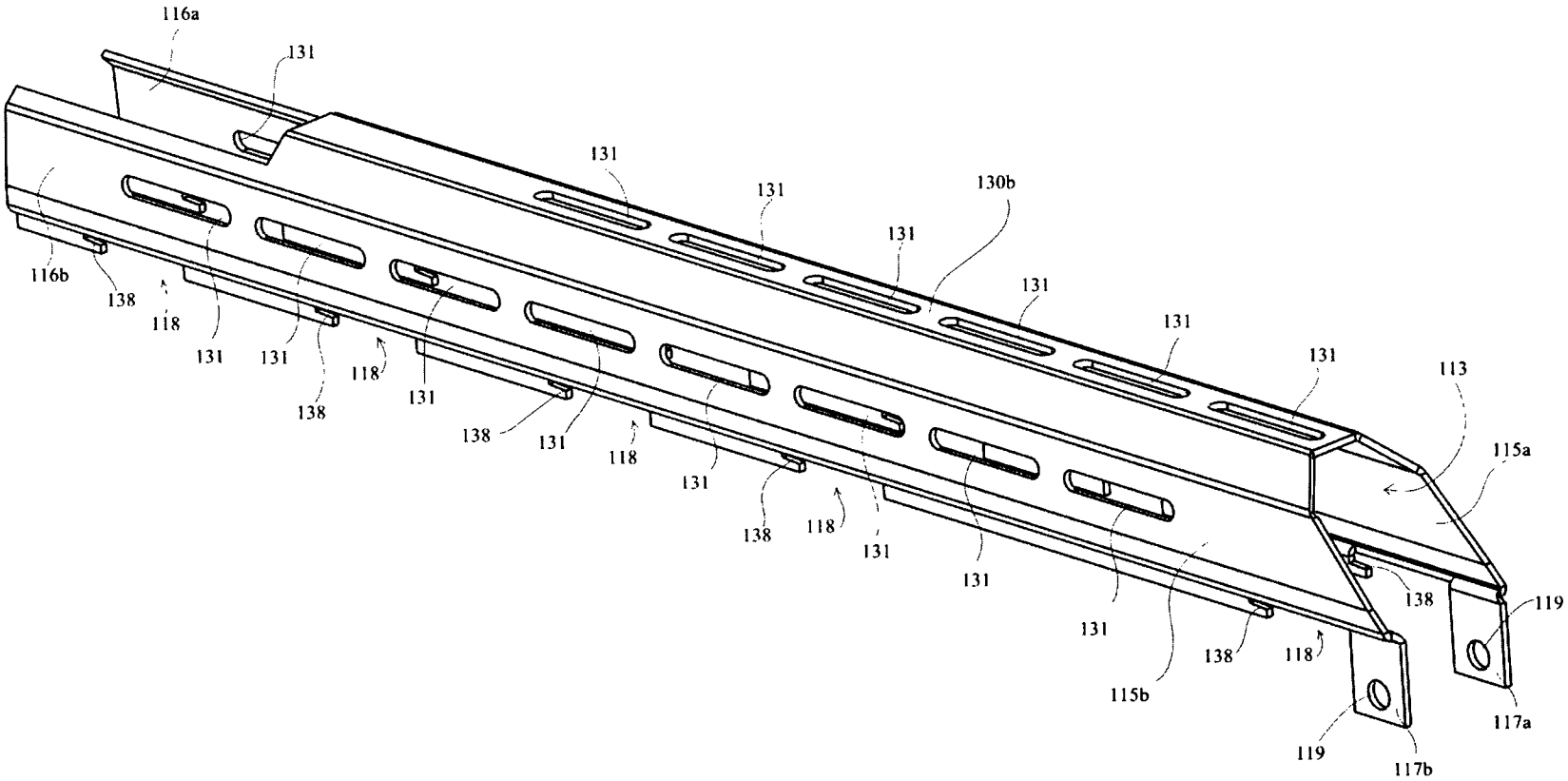

As shown in FIG. 6C, in some implementations, the upper handguard section 130*b* may include a channel 113 therein configured to fit about the gas tube 102*d* of the barreled action 102. In some implementations, the upper handguard section 130*b* may comprise a top portion 114 having two sidewalls 115*a*, 115*b* extending downwardly therefrom. In some implementations, the channel 113 may be defined by the interior side of the top portion 114 and the two sidewalls 115*a*, 115*b* of the upper handguard section 130*b*. In some implementations, the upper handguard section 130*b* may further comprise a first arm 116*a* and a second arm 116*b* that extend from the back end of the first sidewall 115*a* and the second sidewall 115*b*, respectively (see, e.g., FIG. 6C). In some implementations, when the upper handguard section 130*b* is secured to the lower handguard section 130*a*, the sidewalls 115*a*, 115*b* of the upper handguard section 130*b* may be configured to extend along opposite sides of the rear sight of the barreled action 102 (see, e.g., FIG. 1B).

As shown in FIG. 6C, in some implementations, the bottom edge of the sidewalls 115 and the arms 116 of the upper handguard section 130*b* may include a plurality of slots 118 therein. In some implementations, each slot 118 may include an offset recess 138 that has the general shape of a rectangle. In some implementations, each recess 138 may be any shape suitable for receiving therein at least a portion of a lip 137 found on the lower handguard section 130*a* (see, e.g., FIG. 6D).

As shown in FIG. 6C, in some implementations, the upper handguard section 130*b* may include a first flange 117*a* and a second flange 117*b*. In some implementations, the first flange 117*a* and the second flange 117*b* extend down from the first sidewall 115*a*, and the second sidewall 115*b*, respectively, of the upper handguard section 130*b*. In some implementations, the flanges 117 are positioned adjacent the front end of the upper handguard section 130*b*. In some implementations, a thru-bore 119 may extend through the first flange 117*a* and the second flange 117*b* of the upper handguard section 130*b* (see, e.g., FIG. 6C). In some implementations, the first flange 117*a* and the second flange 117*b* may be configured to fit between the sidewalls 135 of the lower handguard section 130*a*. In some implementations, when the flanges 117*a*, 117*b* of the upper handguard section 130*b* are positioned between the sidewalls 135 of the lower handguard section 130*a*, the thru-bore 119 thereof is aligned with the thru-bore 139 of the lower handguard section 130*a*. In this way, a friction pin may be inserted through the aligned thru-bores 119, 139 and thereby secure the front end of the upper handguard section 130*b* to the front end of the lower handguard section 130*a*. In some implementations, the friction pin may also prevent the unintentional longitudinal movement of the upper handguard section 130*b*.

Figure 6D:
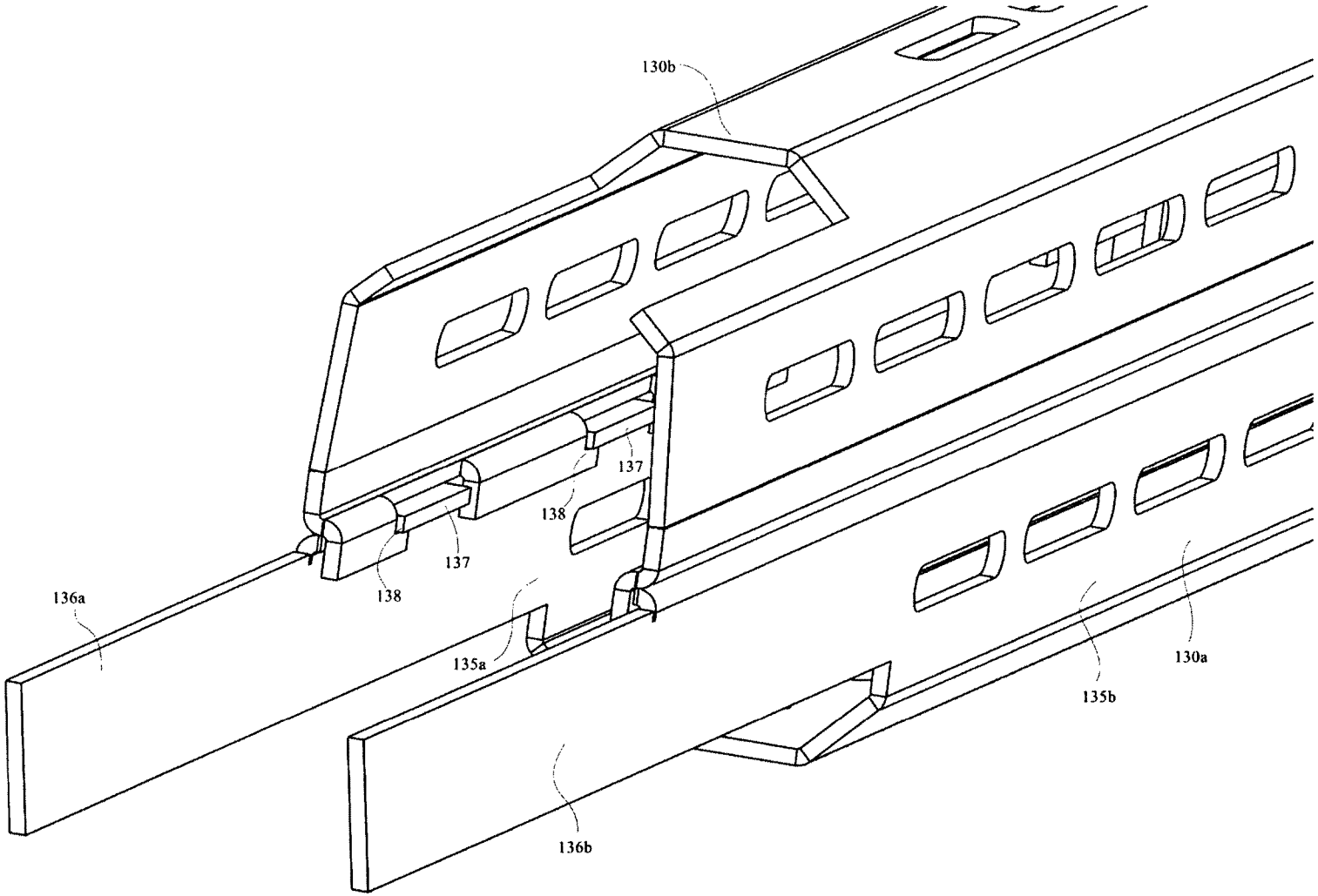

As shown in FIGS. 1A-1C and 3, in some implementations, the upper handguard section 130*b* may be removably secured to the lower handguard section 130*a* using the following steps:

Initially, in some implementations, the upper handguard section 130*b* may be positioned on the lower handguard section 130*a* so that the lips 137 extending from the sidewalls 135 and arms 136 of the lower handguard section 130*a* are received within the slots 118 in the bottom edges of the upper handguard section 130*b* (see, e.g., FIG. 6D).

Next, in some implementations, the upper handguard section 130*b* may be slid forward, towards the muzzle end of the barrel 102*b*, to both: (1) position a portion of each lip 137 within the offset recess 138 of each slot 118 and (2) to align the thru-bores 119, 139 of the handguard sections 130*a*, 130*b*.

Then, in some implementations, a friction pin may be inserted through a first end of each thru-bore 119, 139 and into a second end of each thru-bore 119, 139.

In some implementations, the upper handguard section 130*b* may be removed from the lower handguard section 130*a* by performing the above steps in reverse order.

As shown in FIGS. 1A, 3, 6A and 6C, in some implementations, the lower handguard section 130*a* and/or the upper handguard section 130*b* may include a plurality of negative space mounting slots 131. In some implementations, the bottom portion 134 and the sidewalls 135 of the lower handguard section 130*a* may include one or more mounting slots 131 therein. In some implementations, the top portion 114, the sidewalls 115, and/or the arms 116 of the upper handguard section 130*b* may include one or more mounting slots 131 therein. In some implementations, the mounting slots 131 may be configured to facilitate the attachment of MIL-STD-1913 rail sections and/or firearm accessories (e.g., iron sights, optical gun sights, illumination tools, vertical foregrip, etc.) to the lower handguard section 130*a* and/or the upper handguard section 130*b*. In some implementations, the negative space mounting slots 131 may conform to the M-LOK standard and be configured to receive the T-slot nuts used therewith. In some implementations, the negative space mounting slots 131 may be configured to conform to the KeyMod standard and include a larger diameter through-hole in combination with a narrow slot that extends therefrom. In some implementations, the negative space mounting slots 131 may be replaced with one or more sections of MIL-STD-1913 rail.

In some implementations, the receiver member 140 may be removably secured to the base member 120 and the receiver of the action 102*a*. In some implementations, the receiver member 140 may be configured so that the buttstock adapter 170, the pistol grip 160, and/or the cover 142 may be removably secured thereto. In some implementations, the buttstock adapter 170, the pistol grip 160, and/or the cover 142 may be secured to the receiver member 140 using one or more suitable fasteners (e.g., friction pins, screws, etc.).

As shown in FIG. 1A, in some implementations, when the firearm chassis system 100 is in the bullpup configuration 105, the cover 142 may be secured to the receiver member 140. In some implementations, when secured to the receiver member 140, the cover 142 is configured to enclose the portion of the primary trigger 166*c* protruding from the receiver member 140 and thereby protect it from inadvertent contact. In some implementations, the cover 142 is only used when the firearm chassis system 100 is in the bullpup configuration 105 (see, e.g., FIG. 1A).

Figure 7A:
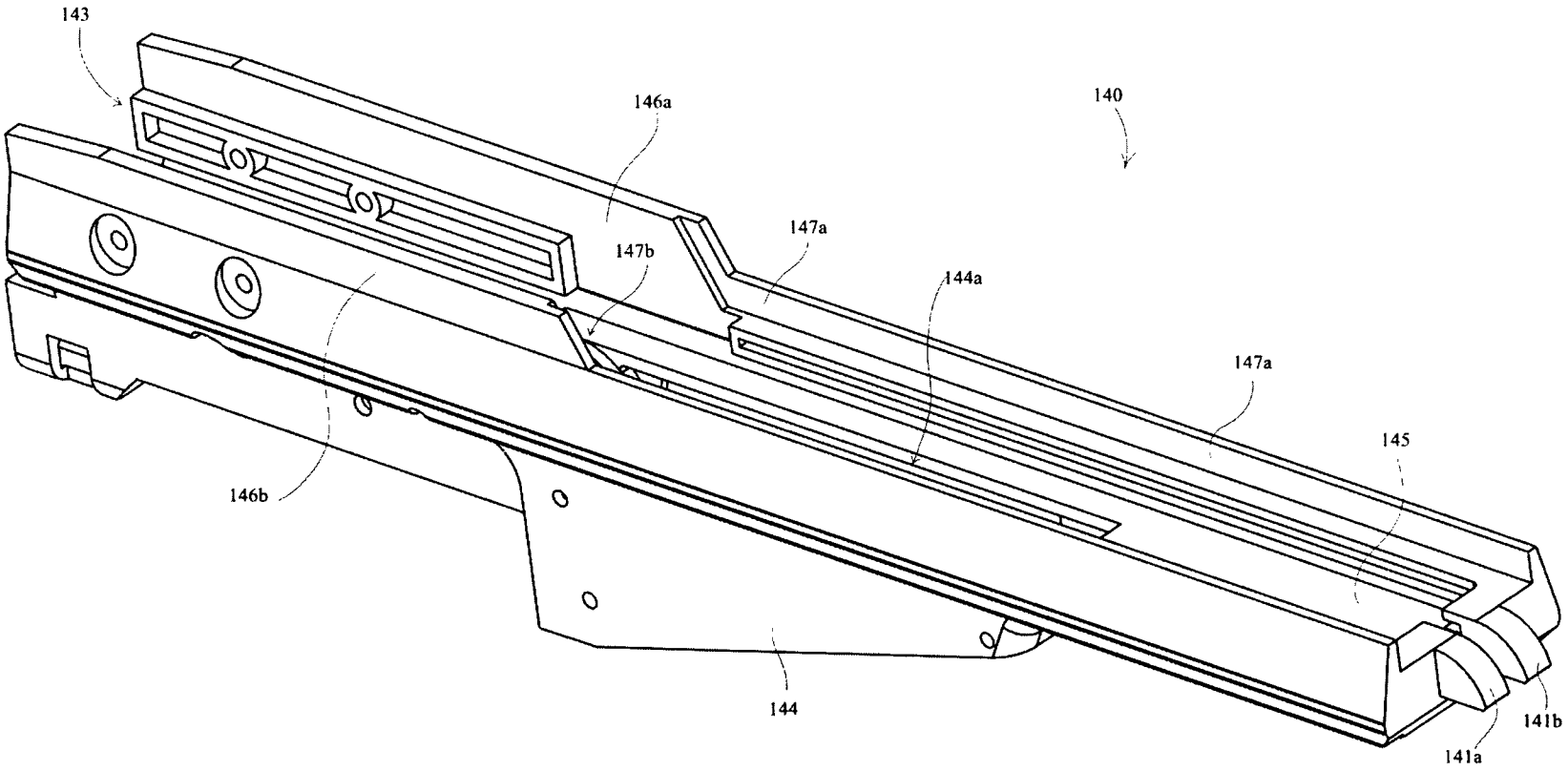
FIG. 7A illustrates an example receiver member according to the principles of the present disclosure.
Figure 7B:
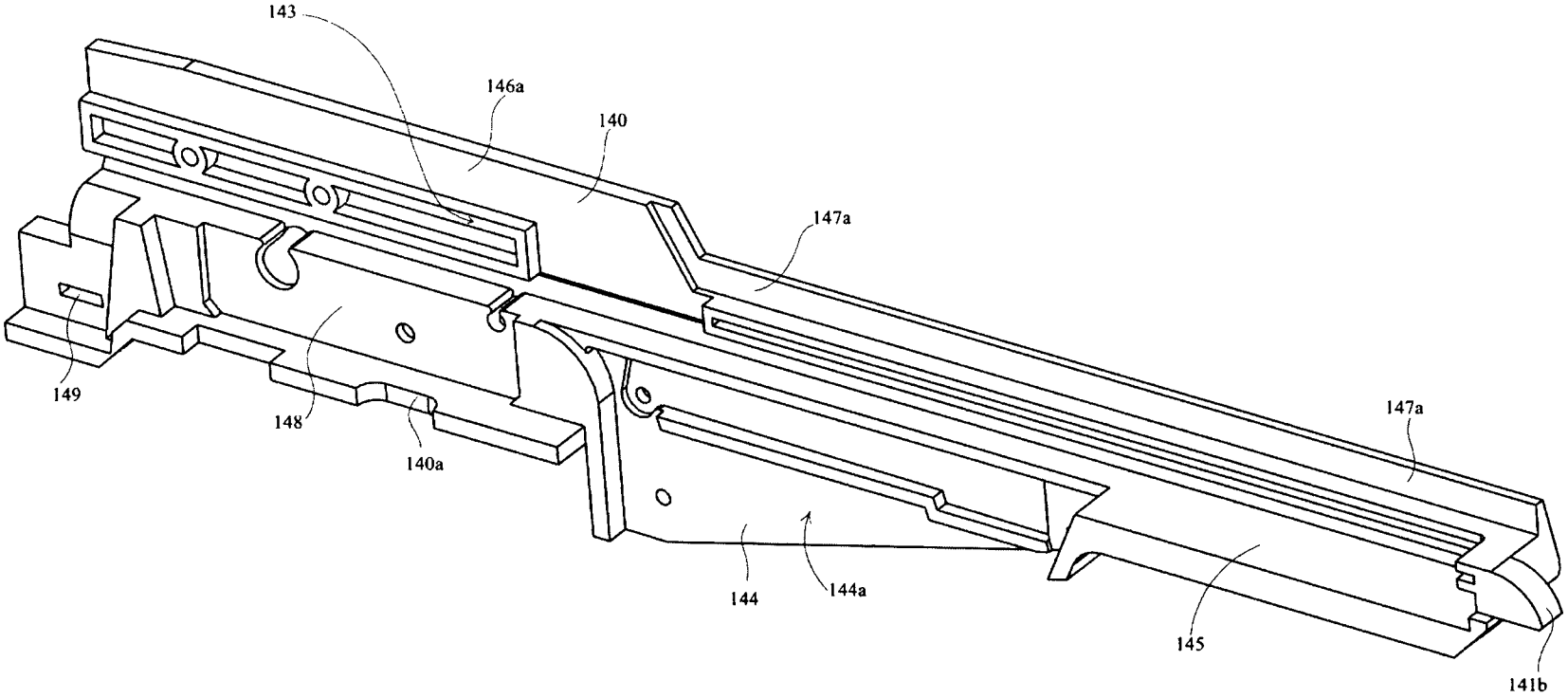
FIG. 7B illustrates a cutaway view of the receiver member shown in FIG. 7A.

As shown in FIGS. 7A and 7B, in some implementations, the receiver member 140 may comprise a bisected tip 141 (elements 141*a*, 141*b*), a magazine well 144 configured to releasably retain an ammunition magazine 103 therein, and/or a pocket 148 configured to receive the fire control group module 165 therein.

As shown in FIG. 7A, the bisected tip 141 extending from the front end of the receiver member 140 may be configured to interface with the contoured surface 127 of the base member 120. In this way, the front end of the receiver member 140 may be prevented from moving side-to-side relative to the base member 120. In some implementations, the opening between the bisected tip 141 of the receiver member 140 may be configured for a portion of the secondary trigger's body 191 to extend therethrough (see, e.g., FIG. 8A).

Figure 7C:
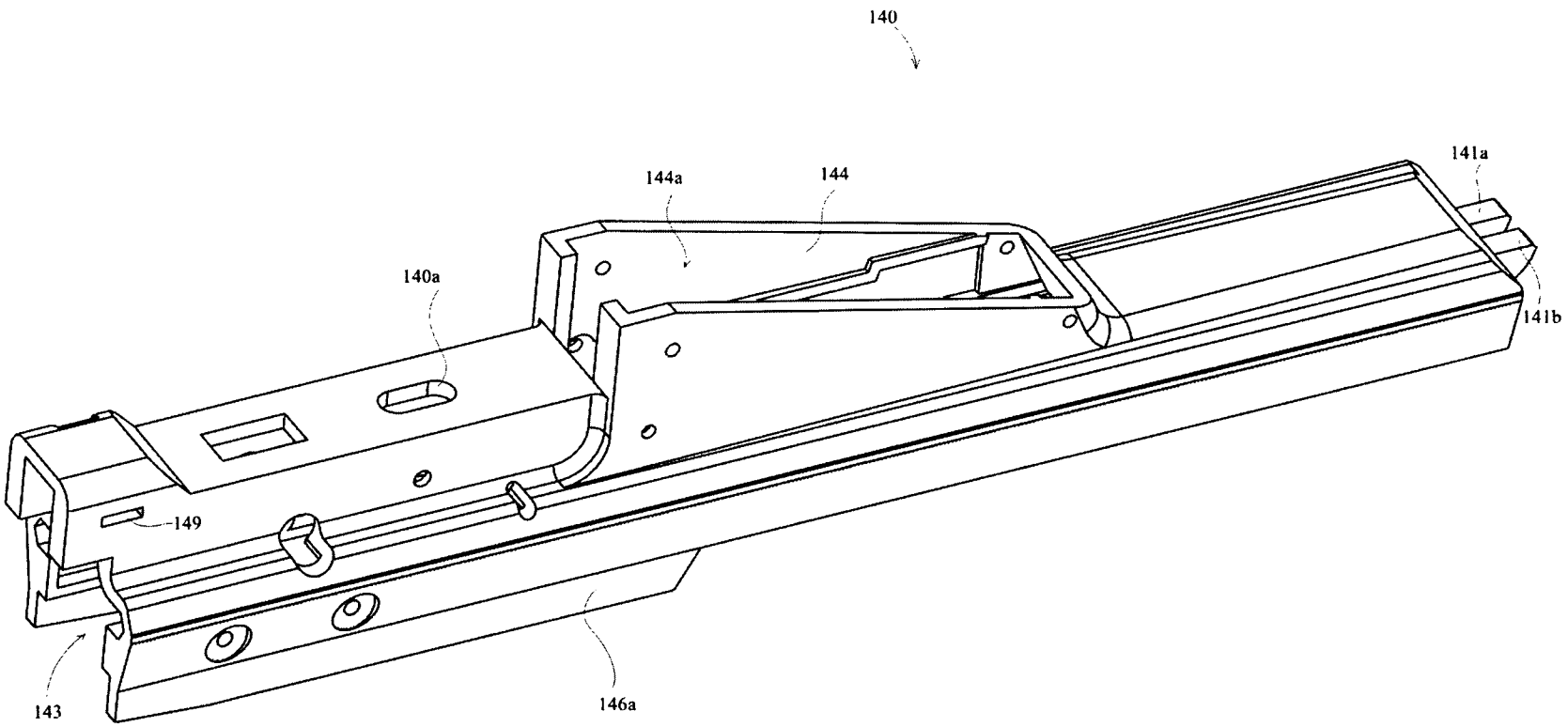
FIGS. 7C-7D illustrate the bottom side of the receiver member shown in FIG. 7A.
Figure 7D:
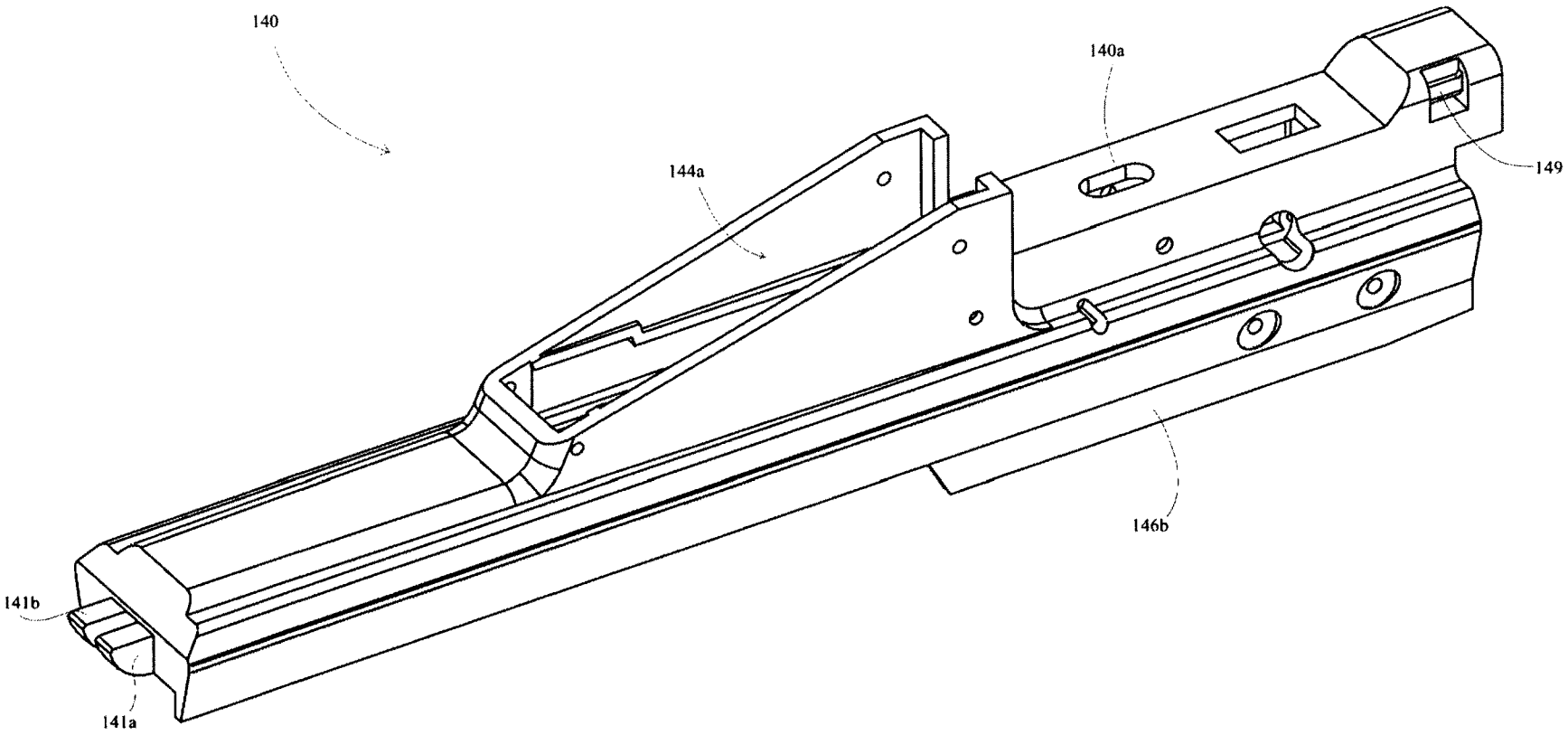

As shown in FIGS. 7B and 7C, in some implementations, the receiver member 140 may include a transverse slot 149 that extends therethrough. In some implementations, the transverse slot 149 may be configured to receive a fastener, having a rectangular cross section, therein. In some implementations, when the receiver member 140 is positioned on the barreled action 102, the transverse slot 149 of the receiver member 140 may be aligned with an opening of the receiver hook 102*f* of the barreled action 102 (see, e.g., FIG. 8A). In this way, the fastener may be used to secure the back end of the receiver member 140 to the receiver of the barreled action 102.

In some implementations, the receiver member 140 may be configured to receive a portion of the barreled action 102 in a channel 143 that extends between the back end and the front end thereof. In some implementations, the channel 143 may comprise an interior bottom portion 145 with two sidewalls 146*a*, 146*b* extending upwardly therefrom.

As shown in FIGS. 7A and 7B, in some implementations, the first sidewall 146*a* and the second sidewall 146*b* of the receiver member 140 may include a first guide groove 147*a* and a second guide groove 147*b*, respectively, therein. In some implementations, the first guide groove 147*a* and the second guide groove 147*b* may be configured to receive and interface with at least a portion of the first arm 136*a* and the second arm 136*b*, respectively, of the lower handguard section 130*a* (see, e.g., FIGS. 1B, and 1C). In this way, a portion of each arm 136*a*, 136*b* of the lower handguard section 130*a* is positioned between a guide groove 147*a*, 147*b* of the receiver member 140 and the barreled action 102.

As shown in FIGS. 1A and 3, in some implementations, the magazine well 144 of the receiver member 140 may be configured to position an ammunition magazine 103 so that ammunition contained therein may be fed into the chamber of the barrel 102*b* by the action 102*a*.

As shown in FIGS. 8A-8D, in some implementations, the magazine well 144 may include a magazine catch mechanism configured to releasably retain an ammunition magazine 103 within the opening 144*a* of the magazine well 144. In some implementations, the magazine catch mechanism may comprise a magazine release lever 151, a biasing lever 152, a sliding support member 153, and/or a spring 154 (see, e.g., FIG. 8A).

Figure 8A:
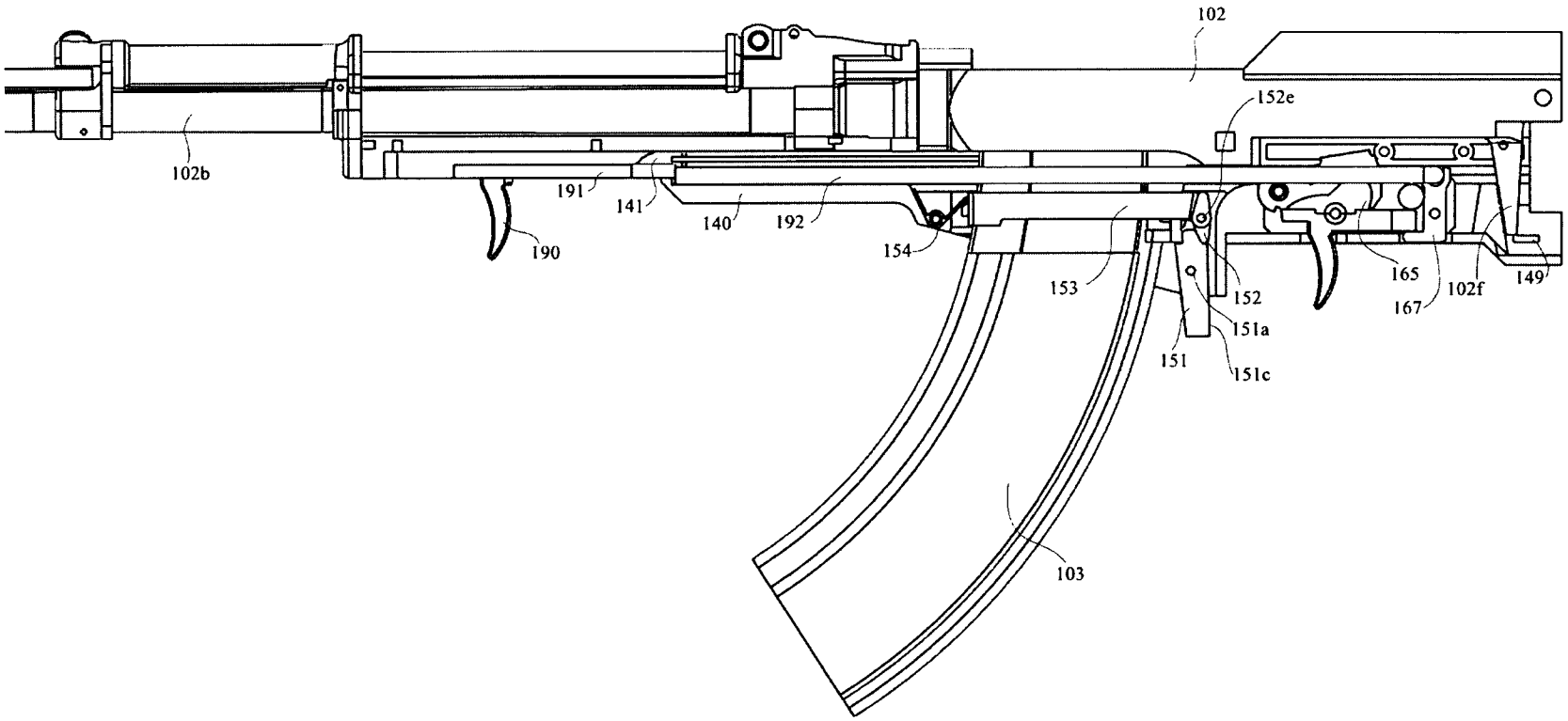
FIGS. 8A-8D illustrate cutaway views of the firearm chassis system, wherein the magazine catch mechanism is shown.
Figure 9A:
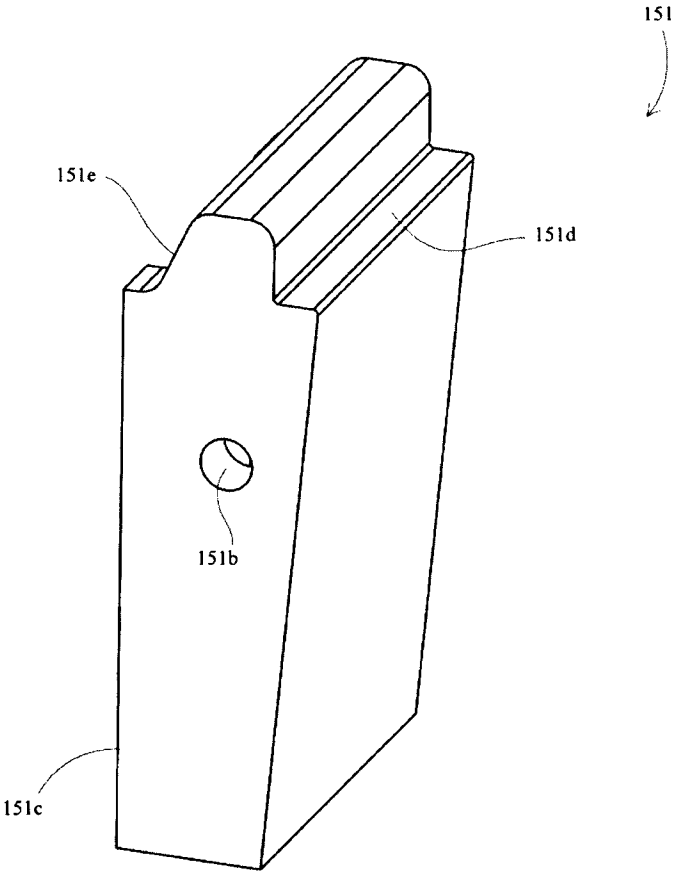
FIGS. 9A and 9B illustrate an example magazine release lever according to the principles of the present disclosure.
Figure 9B:
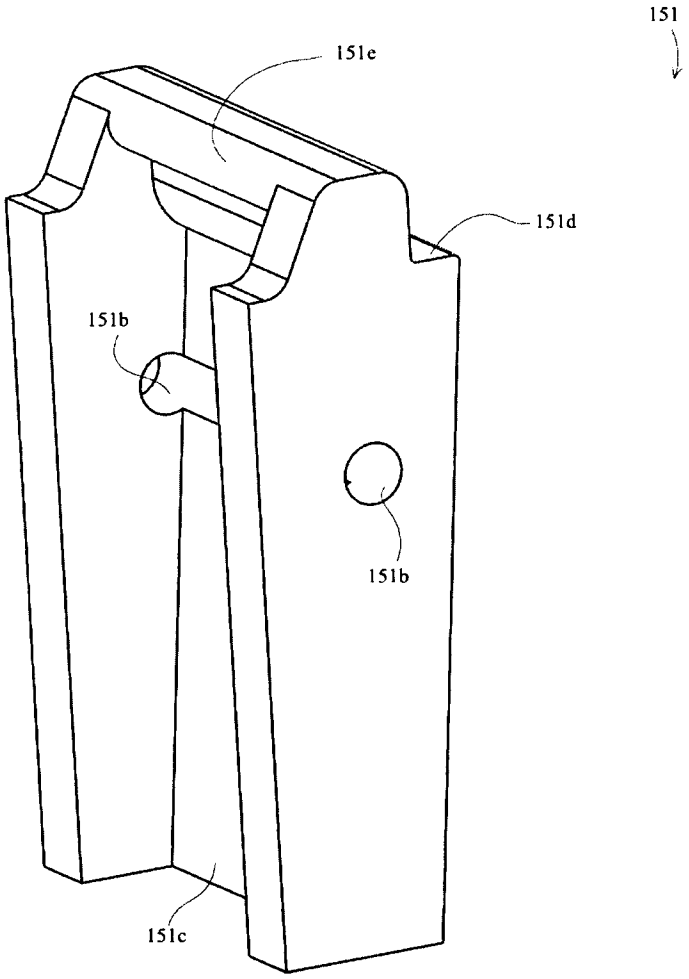

As shown in FIGS. 9A and 9B, in some implementations the magazine release lever 151 may comprise a thru-bore 151*b*, a contact surface 151*c*, a support shelf 151*d*, and/or a biasing lever engagement surface 151*e*. In some implementations, the magazine release lever 151 may be rotatably mounted on a pin 151*a* within the opening 144*a* of the magazine well 144 (see, e.g., FIG. 8A).

As shown in FIGS. 9A and 9B, in some implementations, the contact surface 151*c* may be located on the back side of the magazine release lever 151. In this way, the user may press upon the portion of the magazine release lever 151 that protrudes from the receiver member 140 and thereby release a magazine 103 (see, e.g., FIG. 8A). In some implementations, the support shelf 151*d* may be located on the front side, near the top, of the magazine release lever 151. In some implementations, the support shelf 151*d* may be configured to support thereon a tab 103*a* extending from the back end of an ammunition magazine 103 (see, e.g., FIG. 8B). In some implementations, the biasing lever engagement surface 151*e* of the magazine release lever 151 may be contoured to interface with the biasing lever 152 of the magazine catch mechanism 150.

Figure 10:
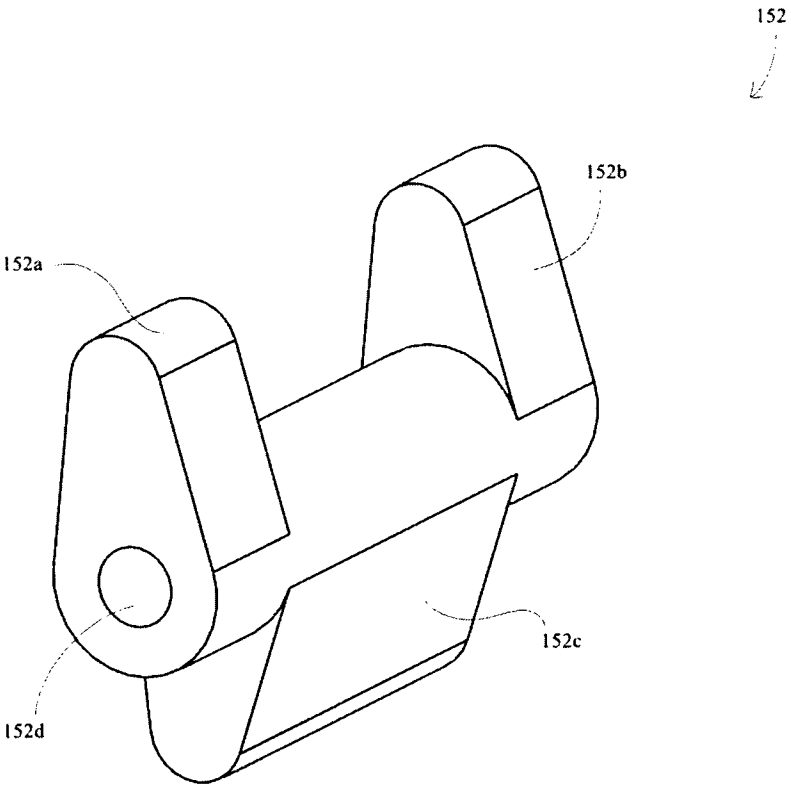
FIG. 10 illustrates an example biasing lever according to the principles of the present disclosure.

As shown in FIG. 10, in some implementations, the biasing lever 152 may comprise a first and second arm 152*a*, 152*b*, a contact member 153*c*, and a thru-bore 152*d*. In some implementations, the biasing lever 152 may be rotatably mounted on a pin 152*e* within the opening 144*a* of the magazine well 144 (see, e.g., FIG. 8A).

Figure 8B:
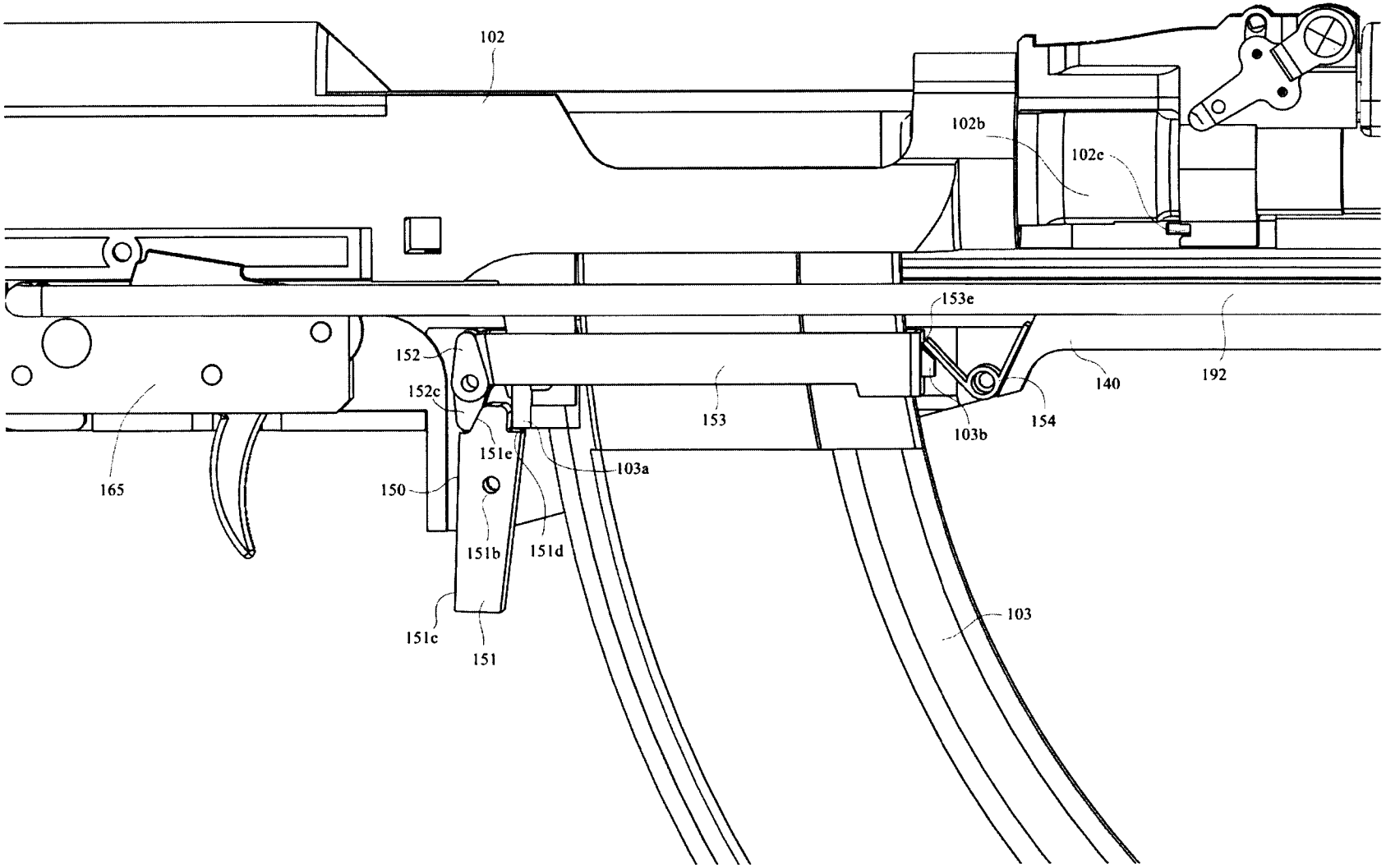
Figure 11:
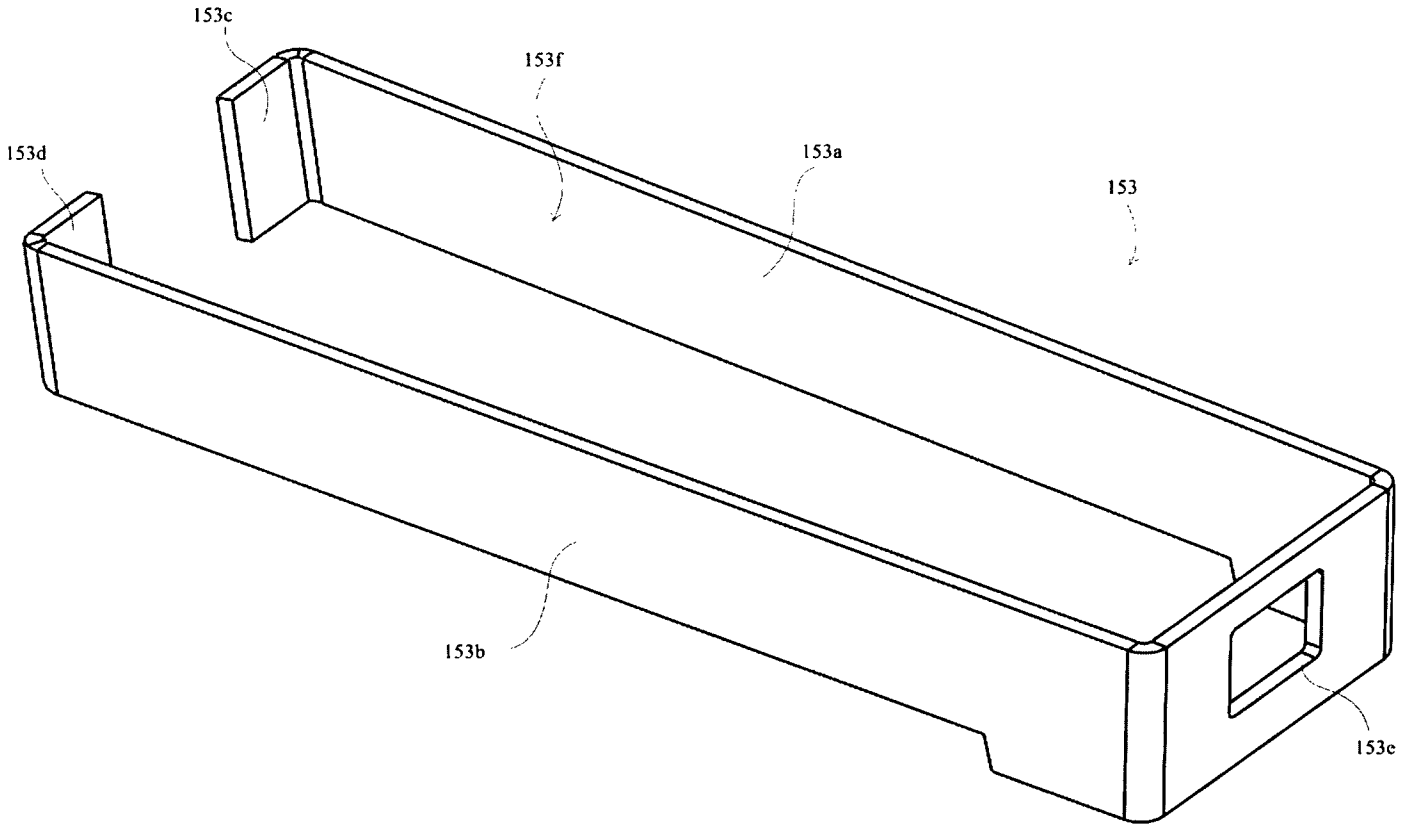
FIG. 11 illustrates an example sliding support member according to the principles of the present disclosure.

As shown in FIG. 11, in some implementations, the sliding support member 153 may comprise a first arm 153*a* having a first contact surface 153*c* extending therefrom, a second arm 153*b* having a second contact surface 153*d* extending therefrom, and an opening 153*e* in a front end thereof configured to receive a tab 103*b* extending from the front end of an ammunition magazine 103 (see, e.g., FIG. 8B).

Figure 8C:
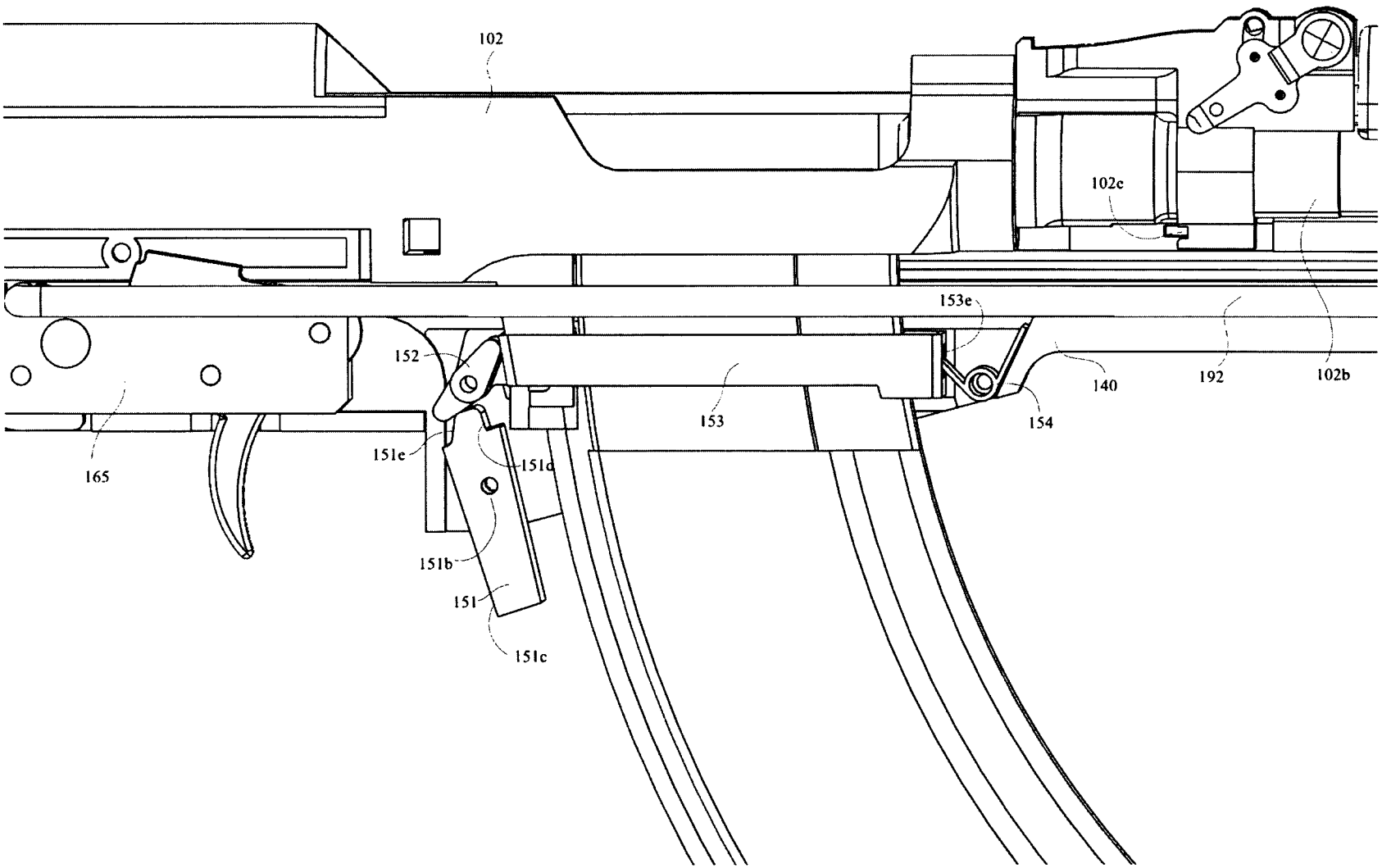
Figure 8D:
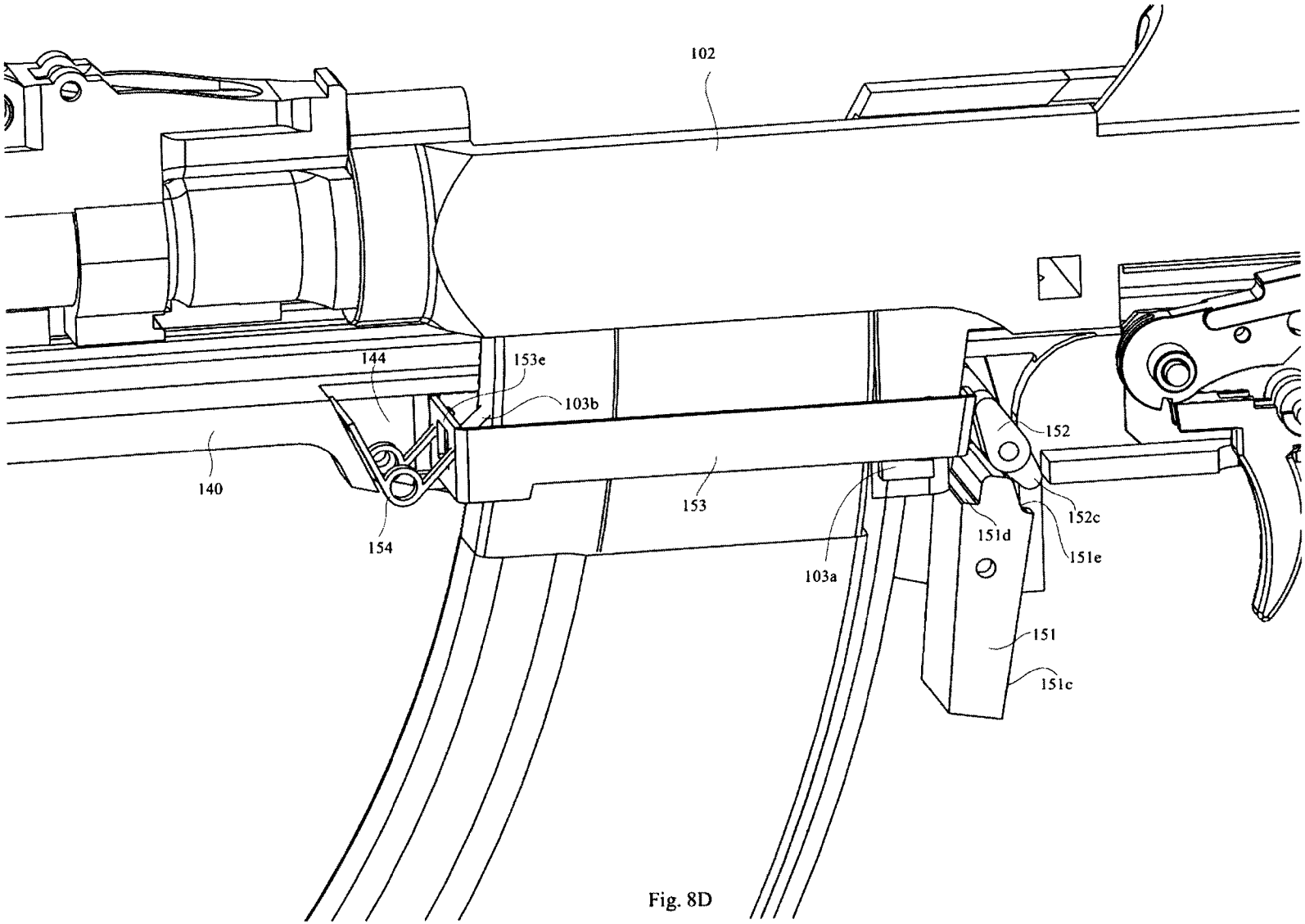

As shown in FIGS. 8D and 11, in some implementations, the sliding support member 153 may define an opening 153*f* therethrough that is configured so that a portion of an ammunition magazine 103 may pass therethrough. In some implementations, the first contact surface 153*c* and the second contact surface 153*d* may extend at a perpendicular angle relative to the first arm 153*a* and the second arm 153*b*, respectively, of the sliding support member 153. In some implementations, the first contact surface 153*c* and the second contact surface 153*d* of the sliding support member 153 extend towards each other, but there is gap therebetween.

In some implementations, the magazine catch mechanism 150 may be configured to move between a first position of operation (see, e.g., FIGS. 8A and 8B) and a second position of operation (see, e.g., FIGS. 8C and 8D).

A shown in FIGS. 8A and 8B, in some implementations, the spring 154 may bias the sliding support member 153 rearwardly and thereby move the magazine catch mechanism 150 into the first position. In some implementations, when the magazine catch mechanism 150 is in the first position, the front tab 103*b* of the magazine 103 may be positioned within, and supported by, the opening 153*e* of the sliding support member 153 while the rear tab 103 of the magazine 103 is resting on the support shelf 151*d* of the magazine release lever 151. In this way, the ammunition magazine 103 may be retained within the magazine well 144 of the receiver member 140 (see, e.g., FIGS. 1A and 3).

As shown in FIGS. 8C and 8D, in some implementations, when the contact surface 151*c* of the magazine release lever 151 is pushed forward (i.e., towards the magazine 103), the support shelf 151*d* thereof is removed from engagement with the rear tab 103*a* of the magazine 103. Further, the engagement surface 151*e* of the magazine release lever 151 acts on the contact member 152*c* of the biasing lever 152 to thereby cause the first arm 152*a* and the second arm 152*b* thereof to press against the first contact surface 153*c* and the second contact surface 153*d*, respectively, of the sliding support member 153. At the same time, the spring 154 is compressed and the sliding support member 153 moved forward thereby removing the opening 153*e* thereof from engagement with the front tab 103*b* of the magazine 103 (see, e.g., FIG. 8C). In this way, the magazine catch mechanism 150 may be placed into the second position. When the magazine catch mechanism 150 is in the second position, the magazine 103 may be removed, or drop free, from the magazine well 144 of the receiver member 140.

As shown in FIGS. 12A-12D, in some implementations, the fire control group module 165 may comprise a hammer 166*a*, a disconnector 166*b*, the primary trigger 166*c*, a safety selector 166*d*, and a trigger engagement member 167 that are supported between a first lateral sidewall 165*a* and a second lateral sidewall 165*b*. In some implementations, the trigger engagement member 167 may be configured to raise the back end of the primary trigger 166*c* and thereby release the hammer 166*a*. In some implementations, a hammer spring is included to, among other things, bias the hammer 166*a* forward to a striking position (i.e., to strike the firing pin of the action 102*a* and thereby cause the firearm to discharge a chambered round of ammunition). In some implementations, a trigger spring is included to, among other things, provide resistance against pulling the primary trigger 166*c*. One or ordinary skill in the art will recognize that other springs (e.g., a disconnector spring) may be used to facilitate the proper function of the fire control group disclosed herein.

Figure 12A:
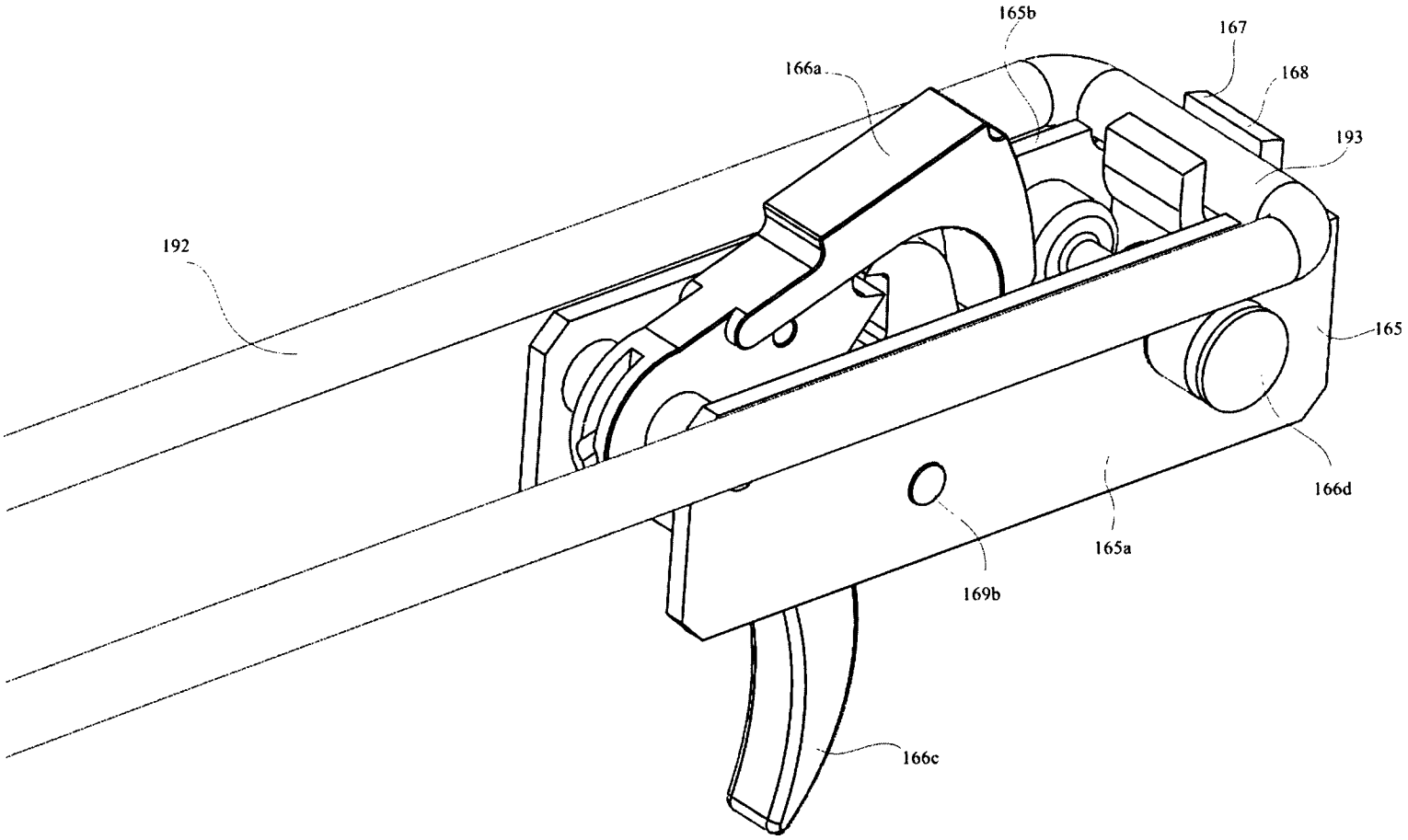
FIGS. 12A-12D illustrate an example fire control group module according to the principles of the present disclosure.

As shown in FIG. 12A, in some implementations, the hammer 166*a*, disconnector 166*b*, primary trigger 166*c*, safety selector 166*d*, and trigger engagement member 167 may be pivotally mounted between the lateral sidewalls 165*a*, 165*b* of the fire control group module 165. In some implementations, the first lateral sidewall 165*a* and the second lateral sidewall 165*b* may be secured between and/or to a first sidewall and a second sidewall, respectively of the pocket 148 in the receiver member 140. In some implementations, the hammer 166*a* may be pivotally mounted on a first pin 169*a*, the disconnector 166*b* and primary trigger 166*c* pivotally mounted on a second pin 169*b*, and the trigger engagement member 167 pivotally mounted on a third pin 169*c* (see, e.g., FIG. 12C). In some implementations, the primary trigger 166*c* may extend through an opening 140*a* in the receiver member 140 (see, e.g., FIGS. 3 and 7C).

Those of ordinary skill in the art will recognize that the fire control group shown (e.g., the hammer 166*a*, disconnector 166*b*, primary trigger 166*c*, and/or safety selector 166*d*) is the same as, or similar to, the fire control group used in the firing mechanism of the COLT® model AR-15® rifle and/or other AR-15 type rifles. However, it is to be understood that the fire control group shown is only for the purposes of example and is not meant to limit the invention to the fire control group shown in the figures.

Figure 12B:
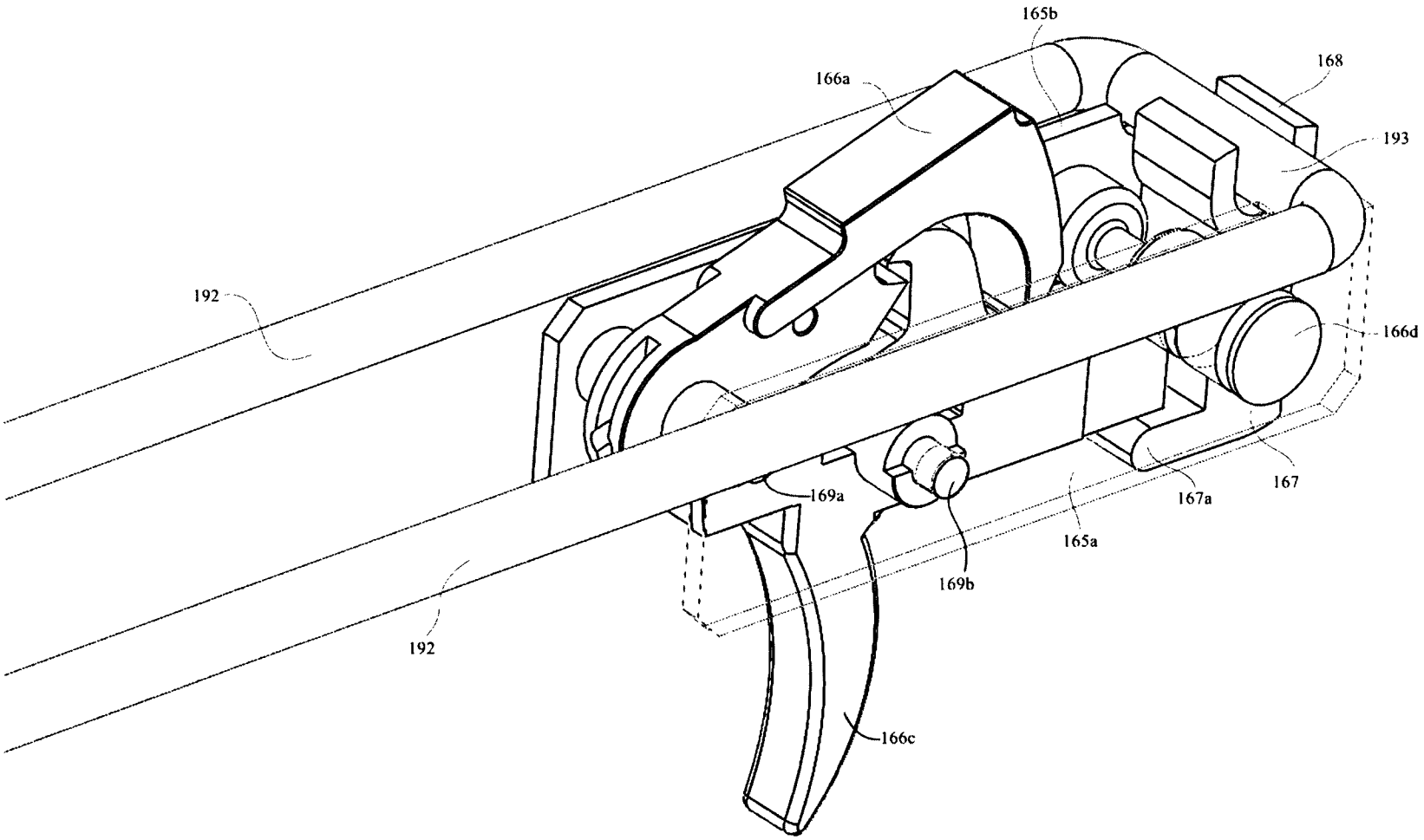
Figure 12C:
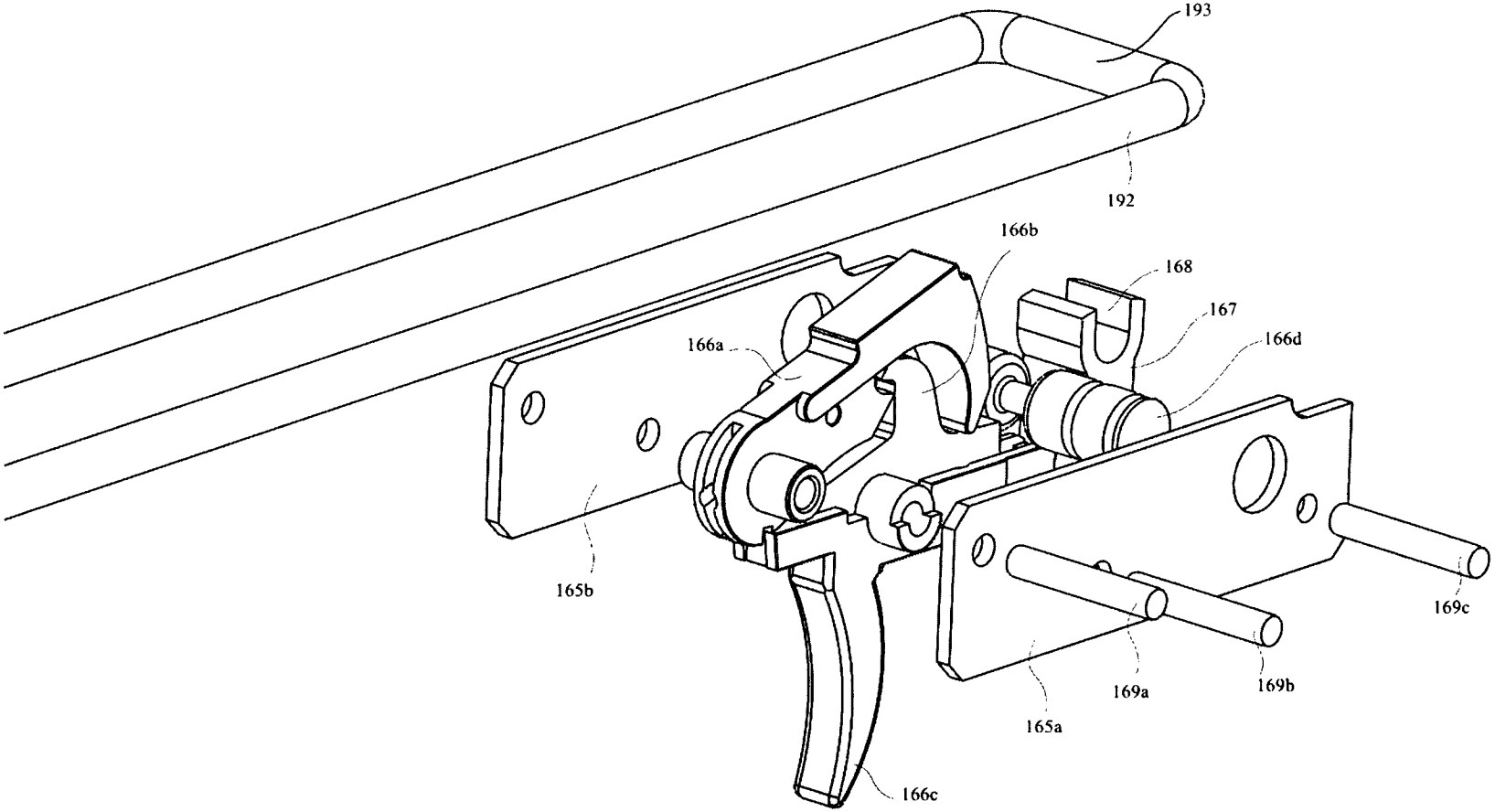
Figure 12D:
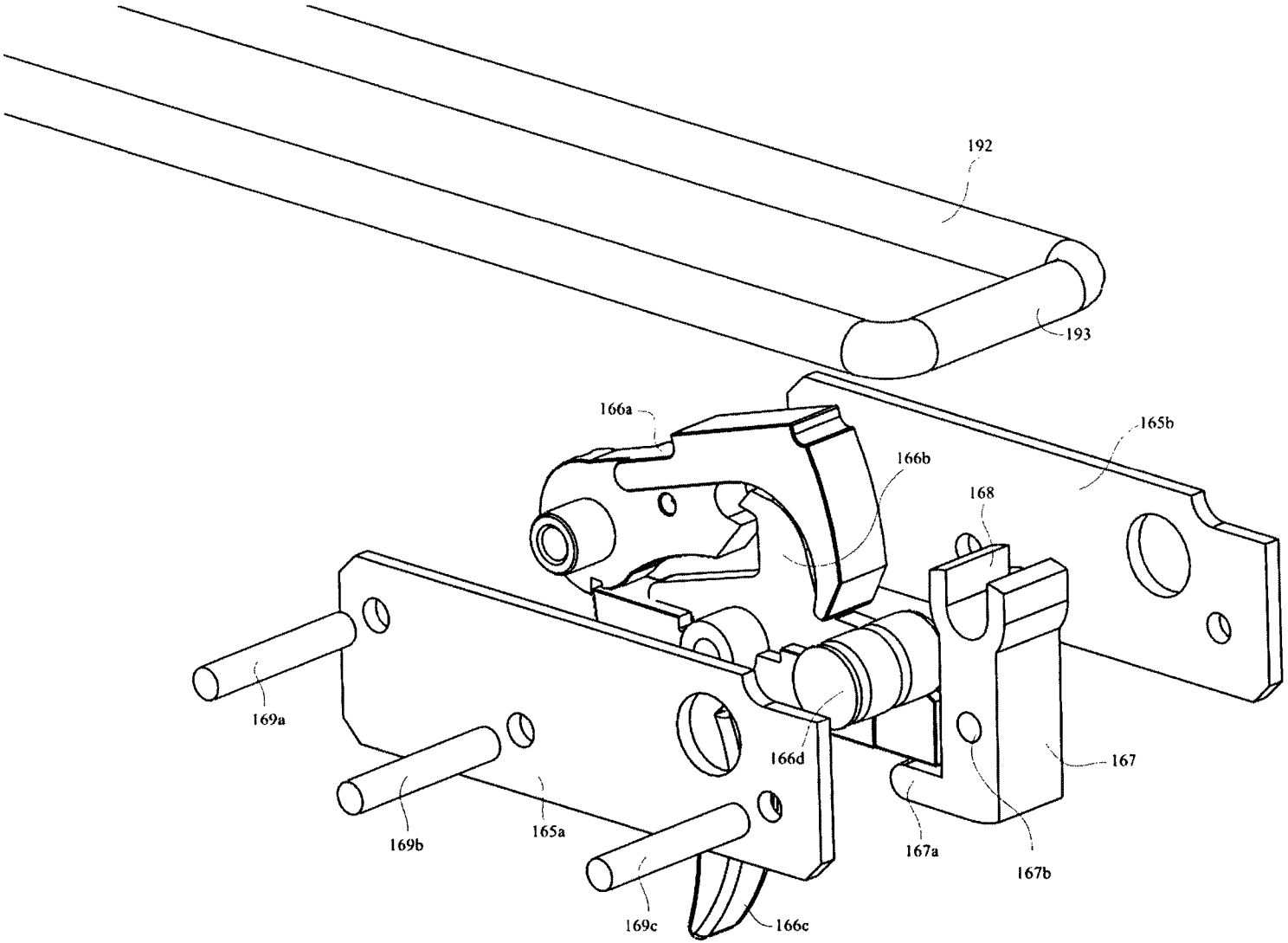

As shown in FIGS. 12B and 12D, in some implementations, the trigger engagement member 167 may comprise a load arm 167*a*, a thru-bore 167*b*, and a trigger linkage joint 168.

As shown in FIGS. 12B and 12D, in some implementations, the load arm 167*a* on the first end of the trigger engagement member 167 may be configured to fit underneath a rear portion of the primary trigger 166*c*. In some implementations, the load arm 167*a* may extend from the trigger engagement member 167 at a perpendicular angle.

In some implementations, the trigger engagement member 167 may be configured to pivot about the pin 169*c* of the fire control group module 165 that extends through the thru-bore 167*b* thereof.

As shown in FIGS. 12A-12D, in some implementations, the trigger linkage joint 168 may be configured to interface with the bend 193 of the trigger linkage 192. In this way, when the trigger linkage 192 moves rearwardly as a result of the secondary trigger 190 being pressed, the trigger engagement member 167 pivots on the third pin 169*c* of the fire control group module 165 causing the load arm 167*a* thereof to lift the rearward end of the primary trigger 166*c* and thereby release the hammer 166*a*. In some implementations, the trigger linkage joint 168 may comprise two upwardly extending arms that define a groove therebetween. In some implementations, the trigger linkage joint 168 may be configured to secure at least a portion of the bend 193 in the trigger linkage 192 between the two upwardly extending arms thereof.

As shown in FIGS. 1A and 3, in some implementations, the buttstock adaptor 170 may be removably secured to the receiver member 140 of the firearm chassis system 100.

Figure 13A:
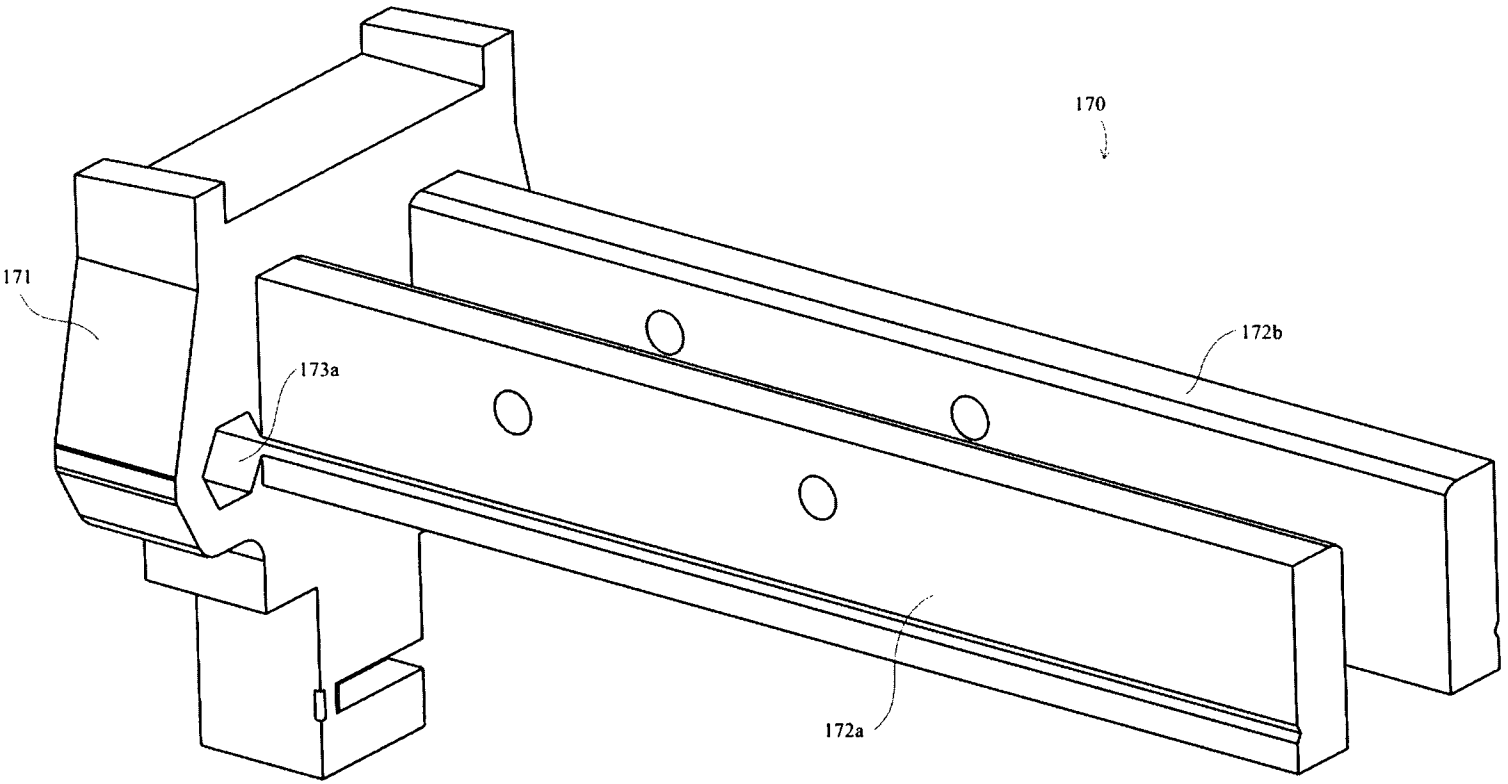
FIGS. 13A-13B illustrate an example buttstock adaptor according to the principles of the present disclosure.
Figure 13B:
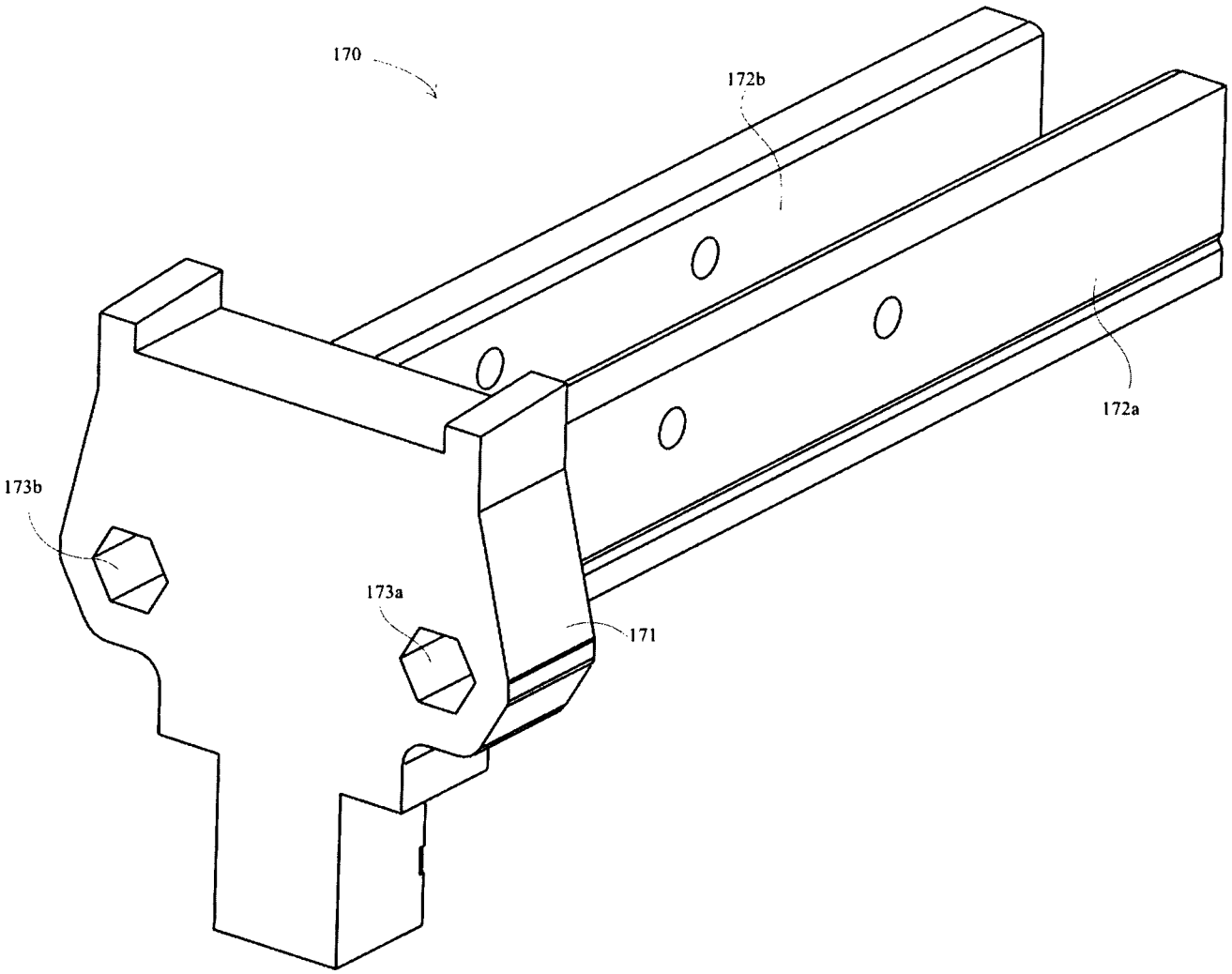

As shown in FIGS. 13A and 13B, in some implementations, the buttstock adaptor 170 may comprise a back plate having a first arm 172*a* and a second arm 172*b* extending therefrom. In some implementations, the first arm 172*a* and the second arm 172*b* may be configured to fit between the first sidewall 146*a* and the second sidewall 146*b* of the channel 143 in the receiver member 140. In some implementations, fasteners (e.g., screws) may be used to secure the first arm 172*a* and the second arm 172*b* of the buttstock adapter 170 to the first sidewall 146*a* and the second sidewall 146*b*, respectively, of the receiver member 140.

As shown in FIGS. 13A and 13B, in some implementations, the back plate 171 of the buttstock adaptor 170 may have a first octagonal opening 172*a* and a second octagonal opening 172*b* that extend therethrough. In some implementations, each opening 172*a*, 172*b* may be configured to receive a guide shaft 182 extending from the collapsible buttstock 180 (see, e.g., FIG. 14). In some implementations, each opening 172*a*, 172*b* may be any suitable shape for receiving a guide shaft 182 of the buttstock 180.

Figure 14:
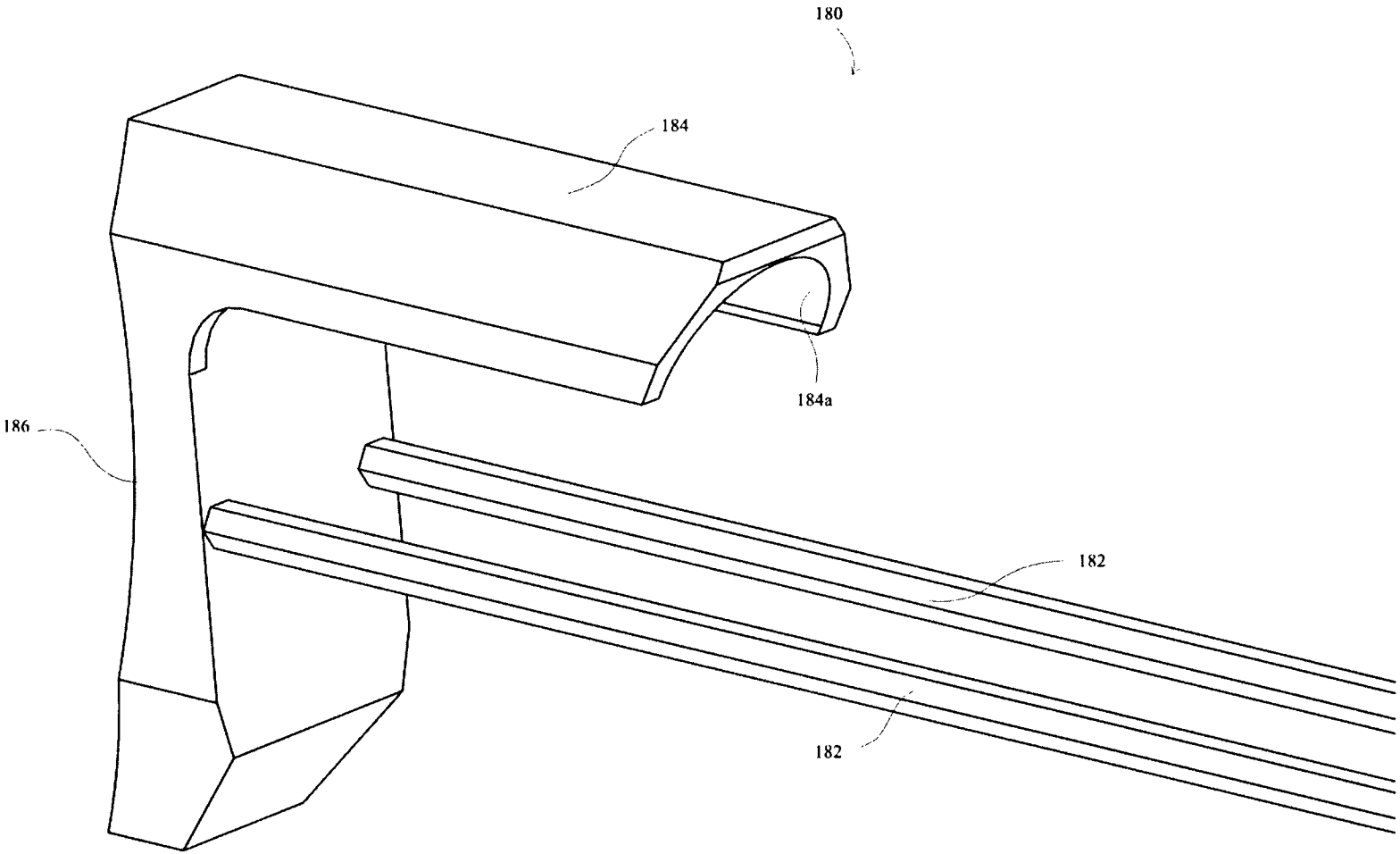
FIG. 14 illustrates an example buttstock according to the principles of the present disclosure.

As shown in FIG. 14, in some implementations, the collapsible buttstock 180 may comprise a cheek piece 184, a butt-pad 186, and two guide shafts 182. In some implementations, as shown in FIGS. 1A and 3, the collapsible buttstock 180 may be moveable between at least a first position (e.g., a fully collapsed position) and a second position (e.g., a fully extended position). In some implementations, the buttstock 180 may be placed into the first position when the firearm chassis system 100 is in the bullpup configuration 105 (see, e.g., FIG. 1A). In some implementations, the buttstock 180 may be placed into the second position when the firearm chassis system 100 is in the rifle configuration 110 (see, e.g., FIG. 3). In some implementations, the guide shafts 182 pass through the openings 172*a*, 172*b* in the buttstock adapter 170 and slide within the channel 143 of the receiver member 140 during operation.

As shown in FIG. 14, in some implementations, the cheek piece 184 of the buttstock 180 may define a channel 184*a* on the underside thereof that is configured to fit about a portion of the receiver of the barreled action 102*a*. In this way, when the buttstock 180 is in the first position, a portion of the receiver of the barreled action 102*a* may be nested within the channel 184*a* (see, e.g., FIG. 1A).

As shown in FIG. 14, in some implementations, the cheek piece 184 may be contoured and shaped so that a user may comfortably rest their cheek thereon during use. In some implementations, the cheek piece 184 of the buttstock 180 may be used as a check rest, or comb, when the firearm chassis system 100 is in either the bullpup configuration 105 (see, e.g., FIG. 1A) or the rifle configuration 110 (see, e.g., FIG. 3).

In some implementations, the butt-pad 186 may be configured (e.g., textured, contoured, etc.) to enhanced shoulder purchase and thereby stabilize a firearm equipped with the firearm chassis system 100 during use (e.g., when fired).

In some implementations, each guide shaft 182 may have an octagonal profile. In some implementations, each guide shaft 182 may be any shape suitable for being received within an opening 172*a*, 172*b* of the buttstock adaptor 170. In some implementations, the guide shafts 182 may be removably secured to the buttstock 180. In some implementations, the guide shafts 182 may not be removably secured to the buttstock 180.

Figure 15:
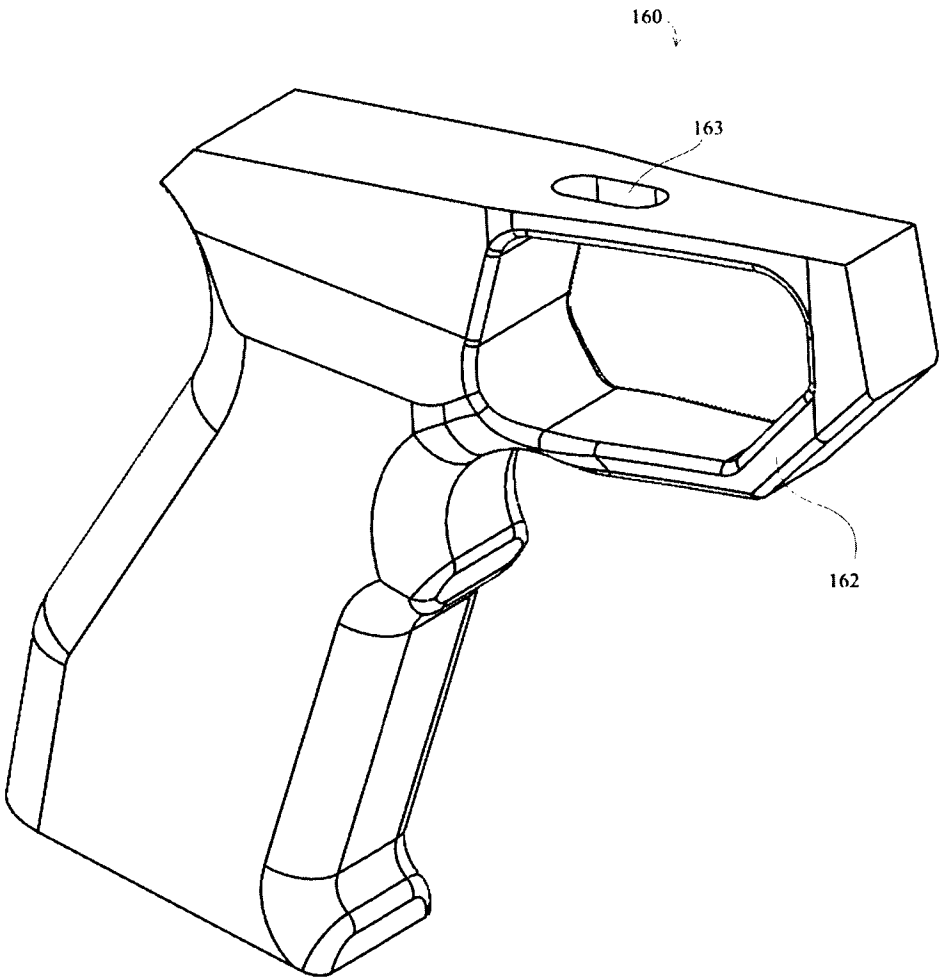
FIG. 15 illustrates an example pistol grip having an integrated trigger guard according to the principles of the present disclosure.

As shown in FIG. 15, the pistol grip 160 may include a slot 163 therein. In some implementations, the slot 163 may extend between a top side of the pistol grip 160 and the opening defined by the trigger guard 162. In this way, a trigger (e.g., 166*c*, 190) can extend through the slot 163 in the pistol grip 160, into the opening defined by the trigger guard 162.

Figure 16:
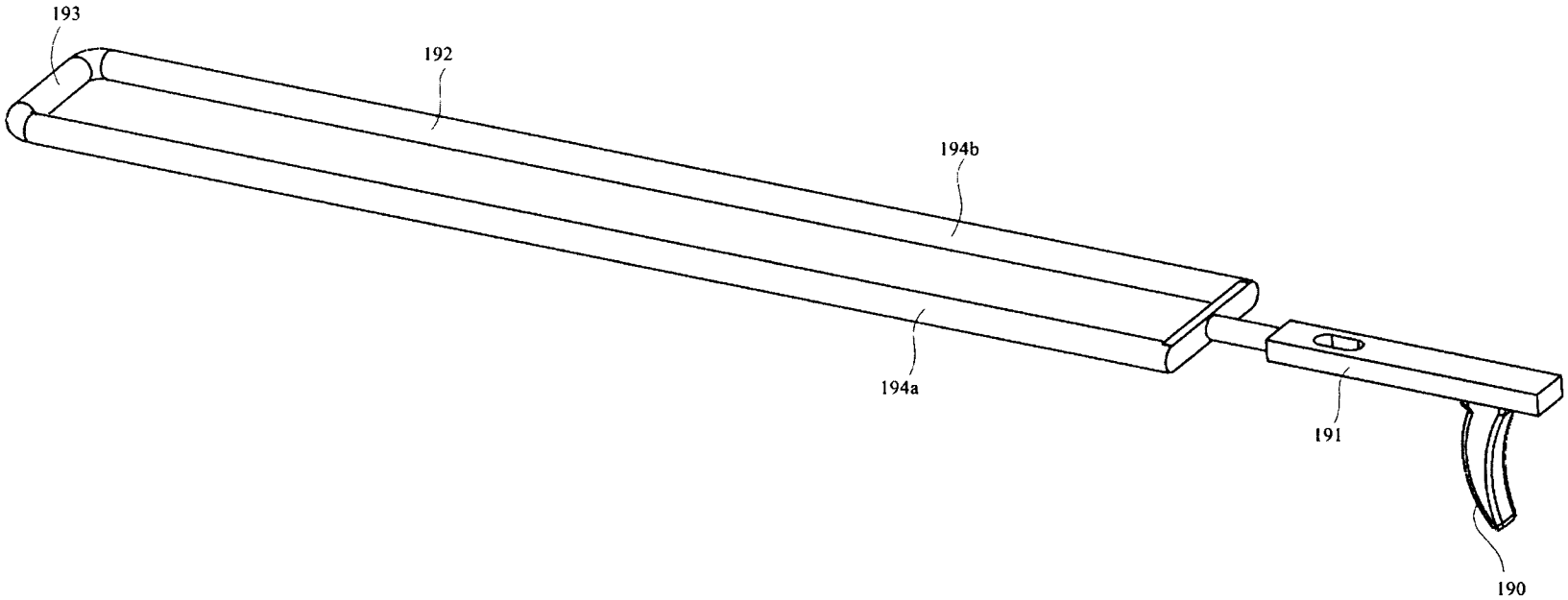
FIG. 16 illustrates an example secondary trigger having the trigger linkage connected thereto according to the principles of the present disclosure.

As shown in FIG. 16, in some implementations, a first end of the trigger linkage 192 may be connected to the body portion 191 of the secondary trigger 190. In some implementations, the trigger linkage 192 may further comprise a first arm 194*a* and a second arm 194*b* (collectively arms 194) that extend between the bend 193 and the front end thereof. In some implementations, the secondary trigger 190 and the trigger linkage 192 are only used when the firearm chassis system 100 is in the bullpup configuration 105 (see, e.g., FIG. 1A).

In some implementations, the bend 193 and/or the arms 194 of the trigger linkage 192 may have a generally cylindrical shape. In some implementations, the cylindrical shape of the bend 193 allows the trigger linkage joint 168 to rotate thereabout during operation. In some implementations, the bend 193 and/or the arms 194 of the trigger linkage 192 may be any suitable shape.

As shown in FIG. 8A, in some implementations, the trigger linkage 192 may extend between the secondary trigger 190 and the trigger engagement member 167 of the fire control group module 165 positioned in the pocket 148 of the receiver member 140. In this way, as discussed above, the secondary trigger 190 may be operationally connected to the trigger engagement member 167 and thereby the hammer 166*a* of the fire control group module 165.

In some implementations, the base member 120 and/or the receiver member 140 of the firearm chassis system 100 may be configured so that the trigger linkage 192 can extend through a portion thereof and reciprocate therein (see, e.g., FIG. 8A).

In some implementations, the factory firing pin of an SKS's barreled action 102 may be replaced with a firing pin having a longer head portion (e.g., approximately 3 mm longer). In this way, the hammer 166*a* of the fire control group module 165 positioned in the pocket 148 of the receiver member 140 is able to make contact with the firing pin. In some implementations, a spring may be positioned between the head of the firing pin and the bolt of the action 102*a*. In this way, the spring may prevent a slam fire from occurring. A slam fire can occur when the bolt chambers a loaded round of ammunition and a free-floating firing pin, due to inertia, strikes the primer with a force sufficient to set off the primer.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown, or in sequential order, or that all illustrated operations be performed, to achieve desirable results.

The invention claimed is:

1. A firearm chassis system configured to be secured to a barreled action of a firearm, the barreled action comprises a receiver and a barrel, the firearm chassis system is configured to convert the firearm between a bullpup configuration and a rifle configuration, the firearm chassis system comprising:

a base member configured to be affixed to the barreled action of the firearm, the base member includes a longitudinally extending channel configured to receive therein a portion of the barrel of the barreled action;

a handguard having exterior surfaces that a user can ergonomically grip, the handguard is configured to be affixed to the base member and includes a longitudinally extending opening through which the barrel of the barreled action extends;

a receiver member, a first end of the receiver member is configured to interface with the base member and a second end of the receiver member is configured to be affixed to the receiver of the barreled action, the receiver member includes a longitudinally extending channel configured to receive a portion of the receiver of the barreled action therein and a magazine well having an opening into which an ammunition magazine may be inserted;

a buttstock adapter configured to be affixed to the receiver member;

a buttstock that is adjustably connected to the buttstock adapter, the buttstock is moveable between a first position and a second position relative to the buttstock adaptor; and a pistol grip having an integral trigger guard, the pistol grip is configured to be secured to an underside of the receiver member and an underside of the handguard;

wherein the pistol grip is secured to the underside of the receiver member when the firearm chassis system is in the rifle configuration and to the underside of the handguard when the firearm chassis system is in the bullpup configuration.

2. The firearm chassis system of claim 1, further comprising an auxiliary trigger located forward of the receiver member that is slidably positioned within a longitudinal slot in an underside of the base member; a trigger linkage configured to operably connect the auxiliary trigger to a trigger and a hammer positioned in the receiver member; and a removable cover, the removable cover is configured to enclose the underside of the receiver member; wherein the removable cover is only secured to the underside of the receiver member when the firearm chassis system is in the bullpup configuration.

3. The firearm chassis of claim 2, wherein the base member includes a protrusion on a front end thereof that is configured to be received within a portion of a handguard cap positioned on the barrel of the barreled action.

4. The firearm chassis of claim 3, wherein the base member includes a first arm and a second arm that extend from a back end thereof, the first arm and the second arm are spaced apart so that a portion of the barreled action can fit therebetween, the arms of the base member are secured to the barreled action by a fastener.

5. The firearm chassis of claim 2, wherein the handguard comprises a lower handguard section and an upper handguard section, the lower handguard section is configured to be affixed to the base member and the upper handguard section is configured to be removably secured to the lower handguard section.

6. The firearm chassis of claim 5, wherein the lower handguard section and the upper handguard section each include a plurality of negative space mounting slots, the negative space mounting slots are configured to facilitate attachment of MIL-STD-1913 rail sections to the handguard.

7. The firearm chassis of claim 2, wherein the magazine well includes a magazine catch mechanism configured to releasably retain an ammunition magazine within the opening of the magazine well, the magazine catch mechanism comprises a magazine release lever, a biasing lever, and a sliding support member; the magazine release lever is configured to support a first end of an ammunition magazine positioned within the magazine well of the receiver member and to release any ammunition magazine secured within the magazine well of the receiver member; the biasing lever is configured to operably connect the magazine release lever to the sliding support member; and the sliding support member is configured to support a second end of an ammunition magazine positioned within the magazine well of the receiver member.

8. The firearm chassis of claim 7, wherein the magazine release lever is rotatably mounted within the opening of the magazine well, the magazine release lever comprises a support shelf configured to support a tab extending from the first end of an ammunition magazine; the biasing lever is rotatably mounted within the opening of the magazine well, the biasing lever comprises a first biasing arm, a second biasing arm, and a contact member; and the sliding support member comprises a first arm having a first contact surface extending therefrom, a second arm having a second contact surface extending therefrom, and an opening in a front end thereof that is configured to receive a tab extending from the second end of an ammunition magazine; wherein the magazine catch mechanism is configured so that when the magazine release lever is pushed forward, the support shelf is moved from under the tab extending from the first end of an ammunition magazine and an engagement surface of the magazine release lever acts on the contact member of the biasing lever, thereby causing the first biasing arm and the second biasing arm to press against the first contact surface and the second contact surface, respectively, of the sliding support member and thereby cause the sliding support member move forward.

9. The firearm chassis of claim 2, further comprising a trigger engagement member that is pivotally mounted within the receiver member, the trigger engagement member is configured to raise a back end of the trigger located in the receiver member and thereby release the hammer in response to the auxiliary trigger being pressed.

10. The firearm chassis of claim 9, wherein the trigger engagement member comprises a load arm and a trigger linkage join, the load arm extends from a first end of the trigger engagement member and is configured to fit underneath a rear portion of the trigger, the trigger linkage joint is configured to interface with a bend in the trigger linkage and thereby operably connect the auxiliary trigger to the trigger and the hammer positioned in the receiver member.

11. The firearm chassis of claim 10, wherein the trigger linkage joint comprises two upwardly extending arms that define a groove therebetween, the groove is configured so that the bend of the trigger linkage fits therein.

12. The firearm chassis of claim 2, wherein the buttstock adaptor comprises a back plate having a first arm and a second arm extending therefrom, the back plate includes a first opening and a second opening that extend therethrough, the first arm and the second arm are configured to fit between a first sidewall and a second sidewall of the longitudinally extending channel of the receiver member; the buttstock includes two guide shafts, the first guide shaft and the second guide shaft are configured to be received within the first opening and the second opening, respectively, in the back plate of the buttstock adaptor.

13. The firearm chassis of claim 2, wherein the trigger linkage comprises a first arm and a second arm that extend between a bend and a front end thereof, the front end of the trigger linkage is connected to the auxiliary trigger and the bend has a cylindrical shape.

14. The firearm chassis of claim 1, wherein the base member includes a protrusion on a front end thereof that is configured to be received within a portion of a handguard cap positioned on the barrel of the barreled action.

15. The firearm chassis of claim 14, wherein the base member includes a first arm and a second arm that extend from a back end thereof, the first arm and the second arm are spaced apart so that a portion of the barreled action can fit therebetween, the arms of the base member are secured to the barreled action by a fastener.

16. The firearm chassis of claim 1, wherein the handguard comprises a lower handguard section and an upper handguard section, the lower handguard section is configured to be affixed to the base member and the upper handguard section is configured to be removably secured to the lower handguard section.

17. The firearm chassis of claim 16, wherein the lower handguard section and the upper handguard section each include a plurality of negative space mounting slots, the negative space mounting slots are configured to facilitate attachment of MIL-STD-1913 rail sections to the handguard.

18. The firearm chassis of claim 1, wherein the magazine well includes a magazine catch mechanism configured to releasably retain an ammunition magazine within the opening of the magazine well, the magazine catch mechanism comprises a magazine release lever, a biasing lever, and a sliding support member; the magazine release lever is configured to support a first end of an ammunition magazine positioned within the magazine well of the receiver member and to release any ammunition magazine secured within the magazine well of the receiver member; the biasing lever is configured to operably connect the magazine release lever to the sliding support member; and the sliding support member is configured to support a second end of an ammunition magazine positioned within the magazine well of the receiver member.

19. The firearm chassis of claim 18, wherein the magazine release lever is rotatably mounted within the opening of the magazine well, the magazine release lever comprises a support shelf configured to support a tab extending from the first end of an ammunition magazine; the biasing lever is rotatably mounted within the opening of the magazine well, the biasing lever comprises a first biasing arm, a second biasing arm, and a contact member; and the sliding support member comprises a first arm having a first contact surface extending therefrom, a second arm having a second contact surface extending therefrom, and an opening in a front end thereof that is configured to receive a tab extending from the second end of an ammunition magazine; wherein the magazine catch mechanism is configured so that when the magazine release lever is pushed forward, the support shelf is moved from under the tab extending from the first end of an ammunition magazine and an engagement surface of the magazine release lever acts on the contact member of the biasing lever, thereby causing the first biasing arm and the second biasing arm to press against the first contact surface and the second contact surface, respectively, of the sliding support member and thereby cause the sliding support member to move forward.

20. The firearm chassis of claim 1, wherein the buttstock adaptor comprises a back plate having a first arm and a second arm extending therefrom, the back plate includes a first opening and a second opening that extend therethrough, the first arm and the second arm are configured to fit between a first sidewall and a second sidewall of the longitudinally extending channel of the receiver member; the buttstock includes two guide shafts, the first guide shaft and the second guide shaft are configured to be received within the first opening and the second opening, respectively, in the back plate of the buttstock adaptor.

* * * * *